US010288369B2

(12) United States Patent
Albury

(10) Patent No.: US 10,288,369 B2
(45) Date of Patent: May 14, 2019

(54) BULLPUP STOCK ASSEMBLY CONFIGURED FOR ACCOMMODATING MULTIPLE FIREARM ASSEMBLIES

(71) Applicant: Peter Richard Albury, Abacos (BS)

(72) Inventor: Peter Richard Albury, Abacos (BS)

( * ) Notice: Subject to any disclaimer, the term of this patent is extended or adjusted under 35 U.S.C. 154(b) by 112 days.

(21) Appl. No.: 15/063,301

(22) Filed: Mar. 7, 2016

(65) Prior Publication Data

US 2017/0131051 A1 May 11, 2017

Related U.S. Application Data

(60) Provisional application No. 62/129,052, filed on Mar. 6, 2015.

(51) Int. Cl.

| | |
|---|---|
| ***F41A 11/00*** | (2006.01) |
| ***F41C 23/00*** | (2006.01) |
| ***F41C 23/20*** | (2006.01) |
| *F41A 19/09* | (2006.01) |
| *F41C 23/12* | (2006.01) |

(52) U.S. Cl.

CPC ..... *F41A 11/00* (2013.01); *F41C 23/00* (2013.01); *F41C 23/20* (2013.01); *F41A 19/09* (2013.01); *F41C 23/12* (2013.01)

(58) Field of Classification Search

CPC ..... F41A 11/02; F41C 23/00; F41C 23/20

See application file for complete search history.

(56) References Cited

U.S. PATENT DOCUMENTS

| | | | | |
|---|---|---|---|---|
| 2,293,128 | A | 8/1942 | Forten | |
| 3,392,450 | A * | 7/1968 | Herter | F41G 1/38 33/297 |
| 3,948,587 | A * | 4/1976 | Rubbert | G01C 3/04 356/21 |
| 4,263,719 | A * | 4/1981 | Murdoch | F41G 1/12 33/277 |
| 6,591,537 | B2 * | 7/2003 | Smith | F41G 1/38 42/122 |
| 6,681,512 | B2 * | 1/2004 | Sammut | F41G 1/38 33/265 |
| 6,729,062 | B2 * | 5/2004 | Thomas | F41G 1/38 42/122 |
| 7,356,958 | B2 | 4/2008 | Weir | |
| 7,827,721 | B2 | 11/2010 | Griffin | |
| 8,549,781 | B2 | 10/2013 | Zamlinsky et al. | |

(Continued)

*Primary Examiner* — Joshua E Freeman
*Assistant Examiner* — Bridget A Cochran

(57) ABSTRACT

A bullpup stock assembly configured for housing a firearm assembly without the use of tools. The bullpup stock includes an upper housing configured to hingedly couple with a lower housing. A hinging means hingedly couples the upper and lower housings such that in a closed configuration the forward ends upper and lower housing are joined, and such that in an open configuration the upper and lower housing are not joined. A bullpup trigger is configured to communicate with a trigger of the firearm assembly by a trigger linkage assembly such that the bullpup trigger activates the firearm when depressed. A block assembly housed with the upper and lower housings is configured to house a firing assembly of the firearm and the trigger linkage assembly. At least one locking means for locking the upper and lower housings together when the forward ends of the upper and lower housing are joined.

18 Claims, 21 Drawing Sheets

(56) References Cited

U.S. PATENT DOCUMENTS

| | | | | |
|---|---|---|---|---|
| 8,615,915 | B2 | 12/2013 | Hunter et al. | |
| 8,782,940 | B1 | 7/2014 | Morris | |
| D720,033 | S * | 12/2014 | Mikroulis | D22/109 |
| 8,910,412 | B2 * | 12/2014 | Mikroulis | F41G 1/473 42/122 |
| D726,280 | S * | 4/2015 | Mikroulis | D22/109 |
| D745,105 | S * | 12/2015 | Mikroulis | D22/109 |
| 2005/0229468 | A1 * | 10/2005 | Zaderey | F41G 1/38 42/122 |
| 2005/0235546 | A1 | 10/2005 | Wonisch et al. | |
| 2006/0026887 | A1 * | 2/2006 | Verdugo | F41G 1/345 42/130 |
| 2006/0236586 | A1 * | 10/2006 | Zaderey | F41G 1/38 42/133 |
| 2007/0022651 | A1 * | 2/2007 | Verdugo | F41G 1/345 42/130 |
| 2009/0235570 | A1 * | 9/2009 | Sammut | F41G 1/473 42/122 |
| 2011/0132983 | A1 * | 6/2011 | Sammut | F41G 1/38 235/404 |
| 2012/0137567 | A1 * | 6/2012 | Sammut | F41G 1/38 42/130 |
| 2012/0240760 | A1 | 9/2012 | Pizano | |
| 2012/0298087 | A1 | 11/2012 | Trpkovski | |
| 2013/0185975 | A1 | 7/2013 | Johnson | |
| 2014/0059915 | A1 * | 3/2014 | Sammut | F41G 1/38 42/122 |
| 2014/0075803 | A1 | 3/2014 | Muller | |
| 2014/0075812 | A1 | 3/2014 | Johnson | |
| 2015/0253108 | A1 * | 9/2015 | Fischer | F41G 3/06 42/122 |
| 2015/0362288 | A1 * | 12/2015 | Sammut | F41G 3/08 235/404 |

* cited by examiner

BULLPUP STOCK ASSEMBLY CONFIGURED FOR ACCOMMODATING MULTIPLE FIREARM ASSEMBLIES

CROSS-REFERENCE TO RELATED APPLICATIONS

This application claims the benefit of the filing date of U.S. Provisional Application Ser. No. 62/139,052, titled STOCK ASSEMBLY HAVING COUPLED SECTIONS filed Mar. 6, 2015 and the subject matter of which is incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to the field of firearms, and more specifically to the field of firearm stocks.

BACKGROUND

Firearms are used for recreational as well as for combat related activities. Many people use rifles as their preferred weapon. Many people desire to modify various weapons including gun stocks in order to suit their personal preference. The stock of a gun is the part of a rifle or other firearm to which the barrel and firing assembly are attached. In the case of a rifle, a portion of the gun stock is held against an individual's shoulder when firing a gun.

Generally speaking, the parts of a gun or rifle can be disassembled from a gun stock to facilitate cleaning of the gun. It is important to clean a gun or rifle to ensure adequate performance of the weapon. Cleaning and disassembling of the parts of a gun can be time-consuming because of the fasteners and components required to maintain the gun within a gun stock in an assembled position.

Many people also choose to change the stock of a gun or rifle. In certain cases, an individual may desire to use a bull pup design stock. The bull pup design places a gun's action behind the trigger and in front of a short butt stock. By making this adaptation, a fire arm's length is decreased while retaining the same barrel length. Generally speaking, bull pup design stocks allow for an approximately 25% reduction in weapon length, which allows for better maneuverability in confined spaces.

As mentioned above, in order to clean a weapon, the components of the weapon must be disassembled from the stock of the rifle. In order to do this, in many cases, several fasteners and components that are required to maintain the components of the firearm within the stock must be un coupled from the stock of a firearm. In most cases, tools are required to disassemble the components of a weapon from the stock of a rifle. Because of this requirement for tools, in many combats situations weapons go uncleaned for long periods of time causing such weapons to malfunction. Additionally, disassembling and assembling the firing assembly from a gun stock can also take a significant amount of time because of the multiple components of the weapon.

As a result, there exists a need for improvements over the prior art and more particularly for a more efficient way of cleaning, assembling and disassembling weapons.

SUMMARY

This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a bullpup stock assembly configured for housing a firearm assembly without the use of tools is disclosed. The bullpup stock includes an upper housing having a rearward end opposing a forward end. The rearward end of the upper housing is configured to hingedly couple with a lower housing. A lower housing includes a rearward end opposing a forward end. The rearward end of the lower housing is configured to hingedly couple with the upper housing. A hinging means is configured for hingedly coupling the upper and lower housings such that in a closed configuration the forward ends upper and lower housing are joined, and such that in an open configuration the upper and lower housing are not joined. A bullpup trigger is configured to communicate with a trigger of the firearm assembly by a trigger linkage assembly such that the bullpup trigger activates the firearm when depressed. The trigger linkage assembly is configured to allow a bullpup trigger to communicate with the trigger of the firearm. A block is assembly configured to house a firing assembly of the firearm and the trigger linkage assembly, wherein the block assembly is configured to be received and constrained by the upper and lower housing when the stock assembly is in a closed configuration. At least one locking means for locking the upper and lower housings together when the forward ends of the upper and lower housing are joined.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein:

FIG. 3AA is an enlarged cross-sectional view of a linking coupler of the bull stock assembly, according to an example embodiment;

FIG. 4AA is a side view of the stock assembly and block assembly with a side of the upper and lower housings removed illustrating the block assembly housing another firearm assembly with the upper and lower housings in joined or closed configuration, according to an example embodiment;

DETAILED DESCRIPTION

Figure 1:
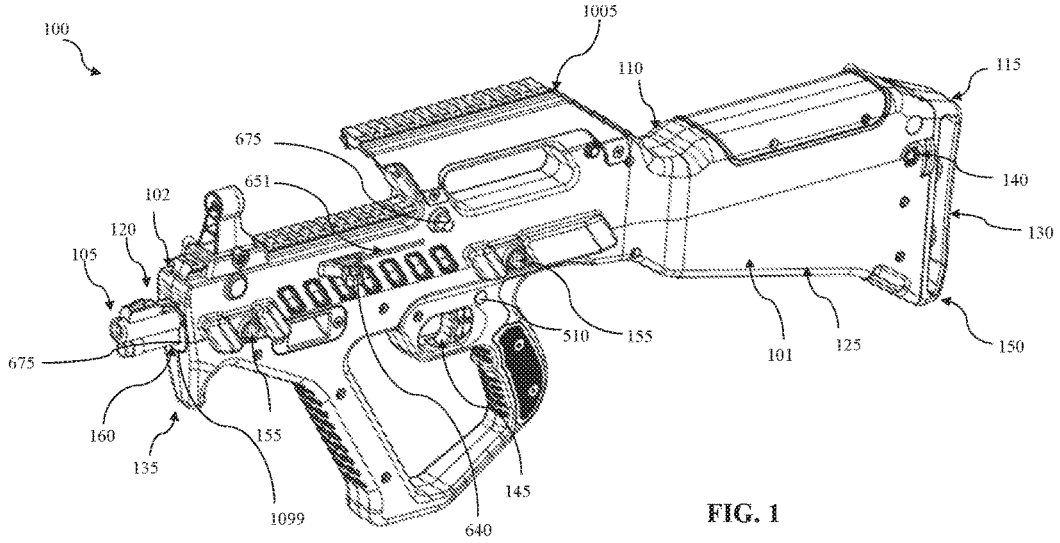
FIG. 1 is a top perspective view of a bull pup stock assembly in a joined state housing a firearm assembly, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a bull pup stock for a gun having an upper housing hingedly attached to a lower housing at a single hinge or pivot point. Additionally, the stock improves over the prior art by having a coupling means for easily and efficiently joining the upper and lower housings of the bull pup stock. Also, the stock improves over the prior art by reducing the amount of time required to disassemble and assemble the gunstock of a weapon. The present invention also improves over the prior art by reducing the amount of tools, such as screwdrivers, Allen keys, socket wrenches etc. needed to assemble the stock. The present invention also improves over the prior art also provides a trigger bearing element that rotatably contacts the trigger of the firing assembly of the firearm such that the trigger rotates corresponding to the movement of the trigger to provide a smoother trigger action or trigger "feel". The present invention provides a bullpup housing that is configured to house a plurality of firearm assemblies. The present invention also improves over the prior art by decreasing the amount of components necessary to access the firing assembly or action and barrel of gun in a bull pup type design stock. The present invention also improves over the prior art by providing a gunstock that is adaptable for several different types of manufacturers, including for aftermarket weapons.

In this document the term "firearm assembly" refers to the components of a rifle removed from the stock of a weapon. The components of the firearm assembly will include the "barrel" and the "action" or "firing assembly" of the firearm. The barrel is the long metal tube, bored out to provide an exit path for a discharging projectile. Once the projectile is fired, it is forced down the barrel and out of the muzzle by expanding gas forces. The bullet travels through the barrel. The term "action" or "firing assembly" in this document will include all the moving parts that load, fire and eject the firearm shells or cartridges. In this document, the term "rearward" is associated with the butt end of the stock or firearm assembly and the term "forward" is associated with the barrel or exit end of the stock or firearm assembly.

Figure 1A:
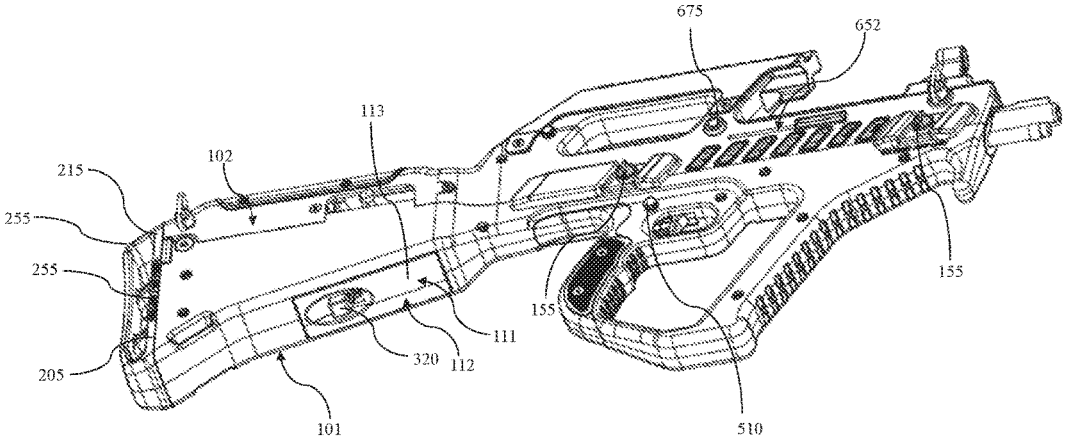
FIG. 1A is a bottom perspective view of the bull pup stock assembly in the joined state housing a firearm assembly, according to an example embodiment.

Referring now to the figures, FIG. 1-FIG. 3 illustrate a bullpup stock assembly 100 configured for housing a firearm assembly 105 without the use of tools. FIGS. 1 and 1A illustrate the bull pup stock assembly in a closed configuration. FIG. 2A is a partially exploded view that illustrates the bull pup stock assembly in an open configuration with the firing assembly 265 constrained within the block assembly 255. The bull pup assembly includes an upper housing 110 having a rearward end 115 opposing a forward end 120. The rearward end of the upper housing is configured to hingedly couple with a lower housing 125. The lower housing has a rearward end 130 opposing a forward end 135. The rearward end of the lower housing is configured to hingedly couple with the upper housing. The upper housing is an elongated shaped body having a first side wall 1001 opposing a second side wall 1003. The forward end of the upper housing has a curved U-shaped feature 161 at its forward end. A handle 1005 may also be formed from the upper housing walls.

Similarly, the lower housing is also an elongated shaped body having a first side wall 1002 opposing a second side wall 1004. The lower housing includes a somewhat triangular shaped butt end 126 at the rearward end of the lower hosing. Additionally, the lower housing also includes a pistol grip or hand grip portion 3060 that is configured to house the bull pup trigger 145 and trigger linkage assembly 321 (further explained below and illustrated in subsequent figures). The forward end of the lower housing also includes a curved U-shaped feature 166 such that when the forward ends of the lower and upper housings are joined in a closed configuration, the upper and lower U-shaped features form a main opening 160.

The walls of the upper and lower housing are configured such that when joined the upper and lower housings are configured to house the block assembly (further explained below) and barrel.

Figure 2A:
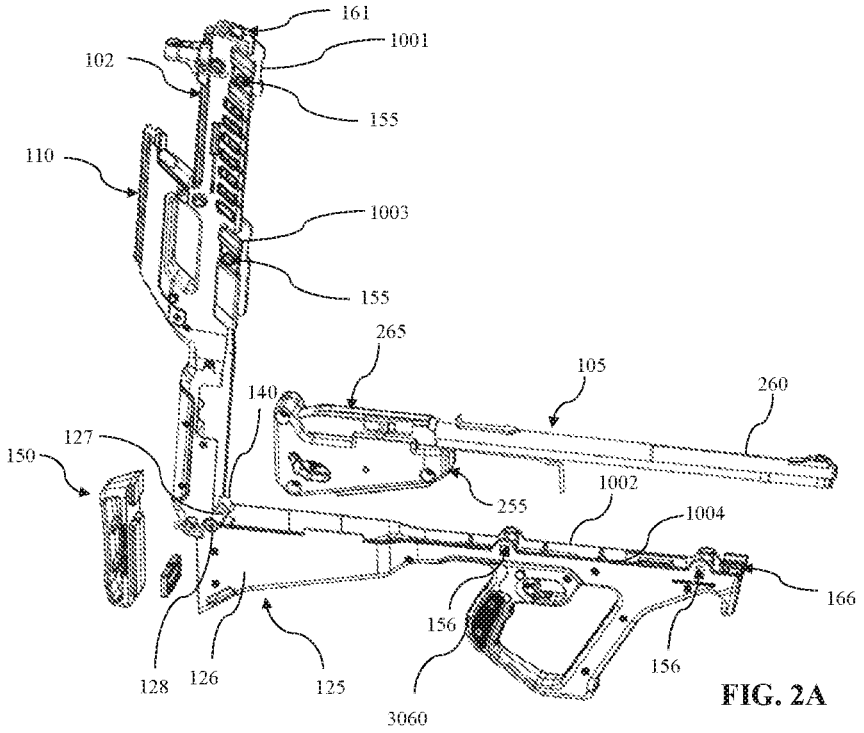
FIG. 2A is a front partially exploded perspective view of the bull pup stock assembly in an un-joined state and a firearm assembly, according to an example embodiment.

A hinging means 140 is configured for hingedly coupling the upper and lower housings. When the stock assembly is in a closed configuration the forward ends of the upper and lower housing are joined as illustrated in FIGS. 1 and 1A. When the stock assembly is in an open configuration the upper and lower housing are not joined as illustrated in FIG. 2A. in the present embodiments, the hinging means includes a series of spaced tubular shaped hinge knuckles 127 on each side of the rearward end of the upper and lower housings that may together to form a hinged barrel. When the hinge barrel is formed, a pin or bolt 128 is positioned and secured inside the hinge barrel such that the hinge knuckles cannot be separated. Such hinge means are well known to those skilled in the art, however the concept of applying a hinge in order to form a bull pup stock assembly has not been used as in this case.

A bullpup trigger 145 is configured to communicate with a trigger 301 (illustrated in FIG. 3C) of the firearm assembly by a trigger linkage assembly such that the bullpup trigger activates the firearm when squeezed. A trigger linkage assembly 321 (further explained below) is configured to allow a bullpup trigger to communicate with the trigger of the firearm such that when the bull pup trigger is squeeze or the rearward force acts on the bull pup trigger, the linkage assembly provides a rearward force to act on the trigger bearing element (further explained below) such that the trigger of the firearm is acted upon.

A block assembly 255 is configured to house a firing assembly 265 of the firearm assembly and the trigger linkage assembly. The block assembly is also configured to be received and constrained by the upper and lower housing when the stock assembly is in a closed configuration as illustrated in FIGS. 1 and 1A. The block will further be explained below.

FIG. 1A is a bottom perspective view of the bull pup stock assembly in the fully assembled state housing a Marlin 60™ firing assembly. However, the upper and lower housings are configured to house other firearm assemblies held within a block assembly. In FIG. 1A, more clearly illustrates certain components of the upper and lower housings. The downward facing section side 111 of the block assembly can is illustrated in FIG. 1A. The lower housing has a block assembly opening 112 that is adapted so that the downward facing side of block assembly is exposed to the outside. The shape of the block assembly opening of the lower housing is a substantially rectangular shaped opening. However other embodiments may also be used. The inside surfaces of the hingedly attached upper and lower housings are configured such that the downward facing side 111 of the block assembly (further explained below) can be flush with the downward facing side 113 of the lower housing.

The bullpup stock also comprises at least one locking means for locking the upper and lower housings together when the forward ends of the upper and lower housing are joined. In the present embodiments, the bull pup stock assembly includes a rearward end locking means 150. Additionally, the present invention also includes side locking means in the form of a pair of quarter turn fasteners that are configured for coupling the first side 101 and second side 102 of the upper housing with the openings 156 along the lower housing.

Figure 2B:
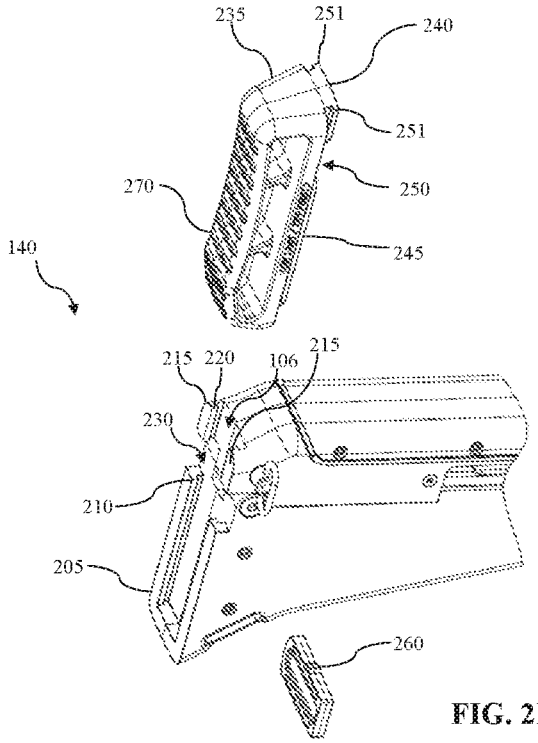
FIG. 2B is a partially exploded perspective view of a rearward locking means of the bull pup stock assembly, according to an example embodiment.
Figure 2C:
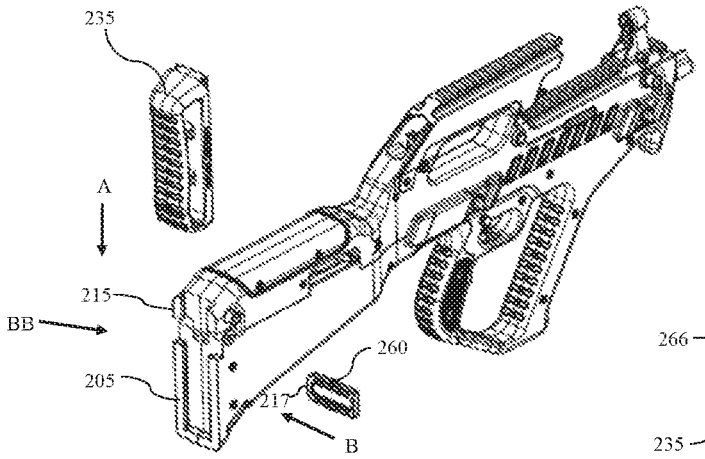
FIG. 2C is another partially exploded perspective view of the rearward locking means of the bull pup stock assembly, according to an example embodiment.
Figure 2D:
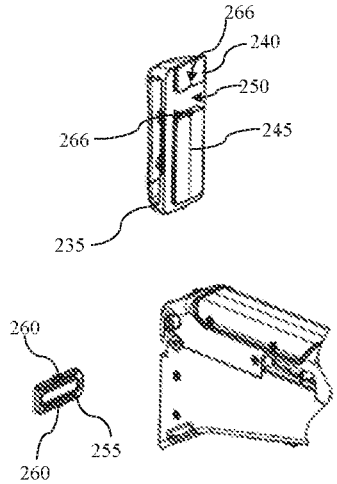
FIG. 2D is another partially exploded perspective view of the rearward locking means of the bull pup stock assembly, according to an example embodiment.

The rearward end locking means 150 is better illustrated in FIGS. 2A-2D. The rearward end locking means includes a u-shaped wall 205 on the rearward end of the lower housing. The u-shaped wall includes a protruding catching feature 210. In the present embodiments, protruding catching feature is an inwardly protruding feature defining a flanged section. A pair of opposing vertically aligned walls 215 are positioned on the rearward end of the upper housing. The vertically aligned walls 215 each include a second protruding catching feature 220. In the present embodiment, the second protruding catching feature is also an inwardly protruding feature defining a flanged section. A first gap 230 is defined between the u-shaped wall and vertically aligned walls when the stock assembly is in the closed configuration (as illustrated in FIGS. 2B and 2C). The gap is sized so that the upper and lower housings can hinge about the pivot point of the hinge as illustrated in FIG. 2A.

The rearward lock also includes a butt cover 235 having a first protruding flanged feature 240 and a second protruding flanged feature 245. The protruding flanged features are separated by a second gap 250. In the present embodiment, the protruding flanged features each include an outwardly protruding rib 251 on each side. The ribs of the protruding flanged features of the butt cover are configured to mate within the groove formed by the protruding catching features of the lower and upper housings when the butt cover is slid into place (as further explained below). A detent groove 266 is positioned along the inward facing edges of the first protruding feature and second protruding feature. Each detent groove is configured to receive a detent protrusion 260 of a lock bar 255 (further explained below).

The butt cover is configured for being positioned as illustrated in FIG. 2C so that first protruding flanged feature 240 is received between the vertically aligned side walls 215 and the second protruding flange feature on the butt cover can be received by the u-shaped wall 205 when the bullpup stock assembly is in the closed configuration. In operation, when in the housings are in the closed configuration, the butt cover can be slid into the opening 106 (see FIG. 2B) and then downward in the direction of line A so that the second gap 250 of the butt cover and the first gap 230 align. FIG. 2A illustrates the butt cover received by the u-shaped walls and having the first and second gaps aligned. To remove the butt cover from the rearward end of the housing, the operation above will be done in reverse.

The rearward locking means also includes a lock bar 255 configured to lock the butt cover into place and prevent the lock bar from inadvertently being removed from the rearward end of the housings. The lock bar is configured to fit into the space formed by the first and second gaps when the stock assembly is in the closed configuration and the butt cover is coupled to the stock assembly as illustrated in FIG. 2A. The lock bar includes a bump or protruding detent 260 on each side of the lock bar. Each protruding detent is configured to mate with a detent groove 266 when inserted into the space formed by the first and second gaps when the bull pup stock is in the closed configuration. In operation, after the stock assembly is in the closed configuration and the butt cover is coupled to the stock assembly, the lock bar can be slid (in the direction of line B) into the space between formed by the first and second gaps. When the lock bar is positioned inside the space, the protruding detents of the lock bar align with the detent grooves of the butt cover thereby forming a catch. The protruding detents are sized such that the dimension from the outer surface of one protruding detent to the outer surface of the second protruding detent is slightly less than the dimension between the first and second protruding flanged features. The material of both the protruding flanged features and the lock bar may comprise material that is somewhat resilient. In operation, when the housings are in the closed configuration and the butt cover is received by the rearward end of the housings as illustrated in FIG. 1A, and when the lock bar enters into the space formed by the first and second gaps, the material of the lock bar or butt cover slightly compresses allowing the protruding detents to enter into the second gap of the butt cover. When the protruding detents enters into the protruding groove of the butt cover, the protruding detents return to their original shape thereby providing a type of catch or locking feature as the resilient material allow the protruding detents to return back to its original shape. In order to remove the lock bar from the butt cover, a force in the direction of line BB must be applied to an end 217 of the lock bar so that the protruding detents may somewhat compress thereby allowing the lock bar to removed. The rearward means is configured so that the rearward ends of the upper and lower housings can be coupled together without the use of tools.

In one embodiment, the locking means can also include at least one quarter-turn fastener on the first side 101 of the stock assembly, and at least quarter-turn one fastener on the second 102 side of the housing. The quarter-turn fasteners are configured for coupling the sides of upper and lower housing together when the stock assembly is in the closed configuration. In the present embodiment, two quarter turn fasters are included on each side of the bull pup assembly. In the present embodiment, a quarter turn fastener similar to the DZUS® pilot quarter turn fastener, however this is not meant to be a limitation and other fasteners may also be used capable of locking the upper and lower housings together without the use of tools may also be used. The quarter turn fasteners are configured so that a first part of each fastener 155 can be turned by human muscle power without the use of tools to open, and turned by a human muscle power without the use of tools to close the fastener in order to couple the upper and lower housings. Referring to FIGS. 2A, 6E and 6F, a first part 155 of the quarter turn fasteners are configured to be rotatably attached to the upper housing. A quarter turn fastener opening 156 is positioned on the lower housing is configured to receive and hold the first part of the quarter turn fastener. When in the latched position, the stud 157 of the first part of the fastener is held into place by clamping prongs 157 (see FIG. 6F) that provide a clamping force that surrounds the stud. However, other fasteners may also be used that can be operated by hand so that side bodies of the upper and lower housings coupled together Referring to 2A, 6E and 6F, first side wall 1001 and second side wall 1003 of the upper housing are configured to fit over the first side wall 1002 and second side wall 1004 of the lower housing. In operation, when joining the upper and lower housings, inward forces may have to be applied to the lower or upper housing to decrease the cross sectional diameter of the lower housing or increase the cross sectional diameter of the upper housing so that the stud 158 of the quarter turn fasteners can be moved over the upper parts of the first and second side walls of the lower housing for the studs of the quarter turn fasteners to be received by the openings 156 of the lower housings. After the studs are received by the opening of lower housing and the second part of the quarter turn fastener, force can be applied using a human hand and without tools to the quarter turn fastener handle so that the clamping prongs of the quarter turn fastener clamps the stud thereby locking the quarter turn fastener in the locked state and thereby locking the side walls of the upper and lower housings together.

Figure 3A:
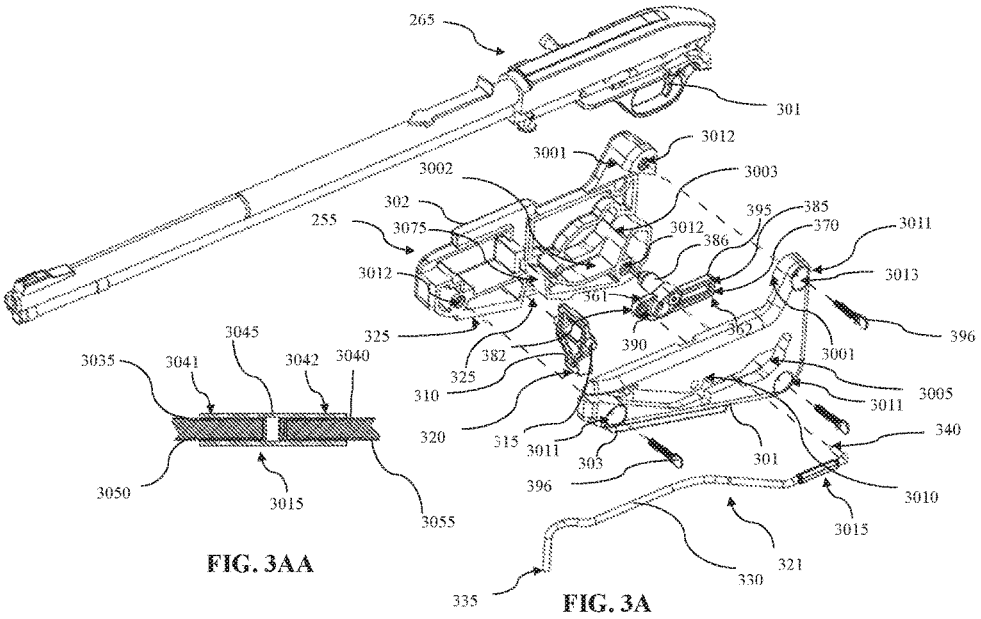
FIG. 3A is a partially exploded view of a firearm assembly and a block assembly of the bull stock assembly, according to an example embodiment.

FIG. 3A is a partially exploded view of the block assembly 255 and firearm assembly of a Marlin 60™. A trigger linkage assembly 321 is configured to allow the bullpup trigger 145 (not illustrated in FIG. 3A) to communicate with the trigger 301 of the firearm assembly. The present invention is configured for the firearm assembly 265 to be housed within the block assembly 255. The block assembly is housed by the upper and lower housings. In FIG. 3A-3D, the firearm assembly of a Marlin 60™ is illustrated. However, the block assembly can be adapted for use with other firearms, such as the Ruger™ 1022, Marlin™ 795 or other types of 22 caliber rifles (as illustrated in FIGS. 8A-8D and further explained below).

The block assembly comprises a first housing 303 configured to couple with the second housing 302. The first housing has a plurality of bosses 3011 configured to align with the threaded holes 3012 of the second housing so that a spade screw 396 and can be screwed into and used couple the first and second housings together. The outside surface of the block assembly proximate to the threaded holes 3012 of the second housing has a cutout 3013 and is configured so that the spade screw can be fastened securely to the first and second housings while providing space for a user to use the digits of a hand to turn or screw the spade screws into the bosses. The cutout 3013 allows a user to tighten the spade screws sufficiently so that the first and second housings of the block assembly are securely joined.

Inside the block assembly has a plurality of surfaces on at least one of the housings of the block assembly that are configured for housing and restraining portions of a firearm. FIGS. 3A-3D illustrate the surfaces 3001, 3002 and 3003 that are arranged so that when the firing assembly 265 of the firearm is positioned inside the block assembly the block assembly restrains the firearm. In FIGS. 3A-3D, the firearm is a Marlin 60™. However, other arrangements of surfaces inside the block assembly may be used so that the block assembly can restrain the outer components by having the outer surface of the firing assembly of the firearm about the surfaces inside the block assembly (see FIGS. 8A-8D)

The block assembly also includes a slot 3005 on one of the housings. The slot is configured for allowing a linking member 330 (explained below) to translate forward and rearward when the linking member is received by the block assembly. In the present embodiment, the slot comprises an elongated shaped horizontally aligned curved cutoff.

Figure 4A:
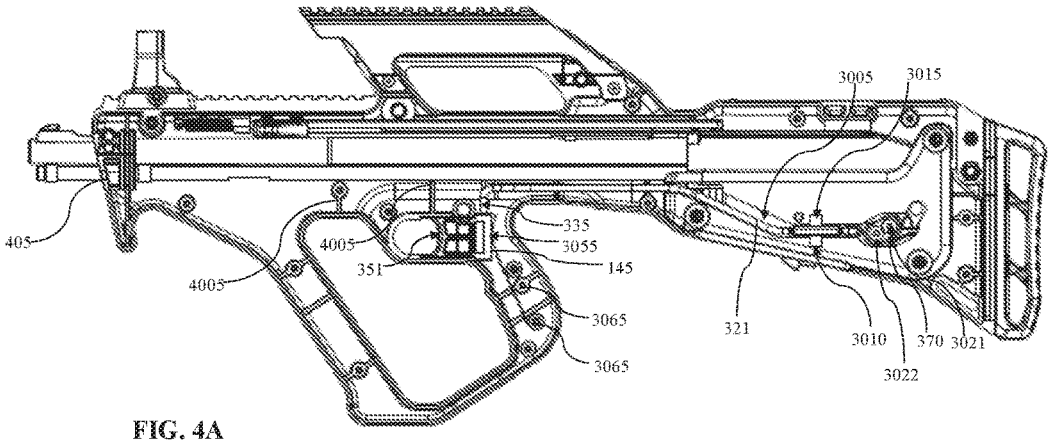
FIG. 4A is a side view of the stock assembly and block assembly with a side of the upper and lower housings removed illustrating the block assembly housing a firearm assembly with the upper and lower housings in joined or closed configuration, according to an example embodiment.
Figure 4A:
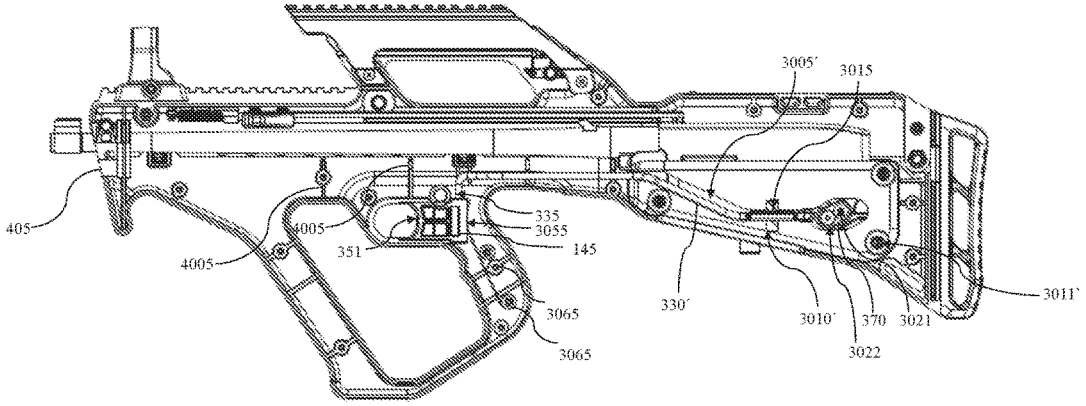

An access aperture 3010 is also included on at least one of the housings of the block assembly and is configured to provide access to a trigger play adjuster 3015 of the trigger linkage assembly (further explained below and illustrated in FIG. 3AA). The access aperture is a rectangular shaped opening perpendicular aligned with the body of the slot 3005. The access aperture is configured so that the when the block assembly is fully assembled and the linkage assembly and firearm assembly is housed within the block assembly, the trigger play adjuster can be adjusted from outside of the block assembly through the access aperture (as illustrated in FIG. 4A).

The trigger linking assembly includes a linking member 330. The linking member is an elongated curved rod having a first or forward end 335 that is curved downwards opposing a rearward or second end 340 that is curved inward. The first end of the linking member is configured to couple with bullpup trigger when the trigger is positioned inside the lower housing (further illustrated in FIG. 4A). The second end of the linking member is configured to couple to a shuttle 370 on the first side 362 of the shuttle at the forward end 382 of the shuttle. A shuttle opening 390 is adapted to receive and hold the second or rearward end of the linking member. The rearward end of the linking member may be coupled or fastened to the shuttle opening via a friction fit, threaded portion, blue, bolted feature, etc. However, such fastenings are not meant to be a limitation and other embodiments may also be used.

The linking member 330 includes a forward linking section 3035 coupled with a 3040 rearward linking section by a linking coupler 3045 thereby defining the linking play adjuster 3015. The forward end 3041 of the linking coupler is configured for coupling with the forward linking section by a first thread arrangement 3050. A rearward end of the linking coupler 3042 is configured for coupling with the rearward linking section by a second thread arrangement 3055 such that rotating the threaded coupling adjusts a length of the linking member. In operation, when the linking coupler is rotated it lengthens or shortens the length of the linking member, which in turn moves the trigger bearing element 386 closer or further away from the trigger 301 of the trigger assembly.

Figure 3B:
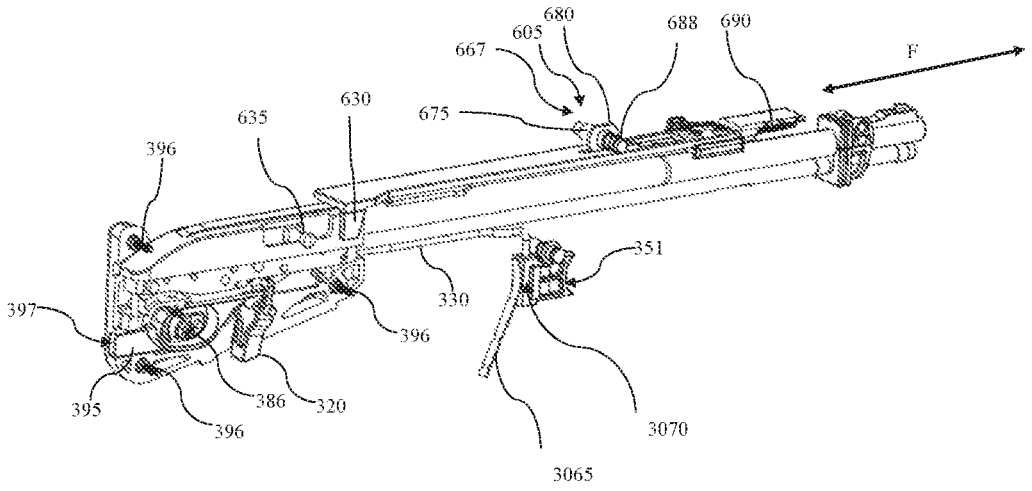
FIG. 3B is a perspective view of the block assembly, trigger link assembly, bolt lock and trigger lock of the bull pup stock assembly configured on a firearm assembly, according to an example embodiment.
Figure 3C:
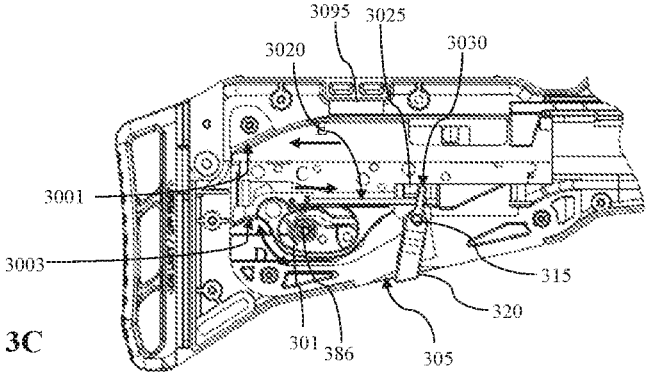
FIG. 3C is a side partial view of the stock assembly and block assembly with a side of the upper and lower housings and block assembly removed illustrating a release button of the firing assembly in a forward position, according to an example embodiment.
Figure 3D:
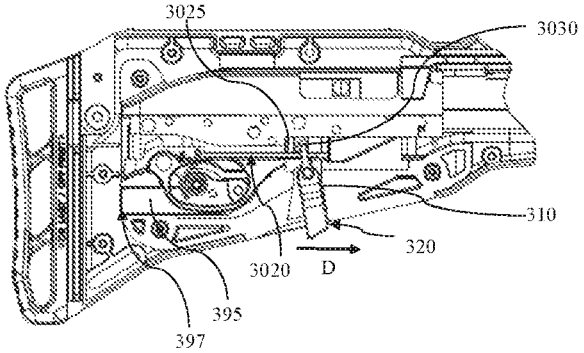
FIG. 3D is a side partial view of the stock assembly and block assembly with a side of the upper and lower housings and block assembly removed illustrating a release button of the firing assembly in a rearward position, according to an example embodiment.

The rearward end of the shuttle 385 includes a bearing element 395. In the present embodiment, when assembled in the block assembly (as illustrated in FIGS. 3B-3D) the bearing element is configured for forward and rearward translation within a bearing slot 397 of the block housing. In the present embodiment, the bearing element is such that it facilitates the linking member to translate forward and rearward along a constrained path. In the present embodiment, the bearing defines a rectangular shaped block (illustrated in FIG. 3D.

A trigger bearing element 386 is rotatably coupled to and protruding from a second side 361 of the trigger shuttle. The trigger bearing element is configured to be accepted into either a forward opening 3022 or a rearward opening 3021 of the trigger shuttle. In FIG. 3A, the trigger bearing element is coupled inside the rearward opening 3021 and is arranged for a Marlin 60™ firearm assembly. However, in other embodiments, the trigger bearing element may be coupled to the rearward opening (such as for the Ruger 1022™ as illustrated in FIG. 4A, 8A-8D). In one embodiment, the trigger bearing element may include a threaded end that is adapted to mate with corresponding threads of either the forward opening or the rearward opening. In FIG. 3A the trigger bearing element is coupled within the rearward opening. As mentioned above FIG. 3A, represents the configuration of the block assembly that is adapted for receiving a Marlin 60™.

The trigger bearing element is configured to interact with the trigger 301 of the firearm when the firearm is received by the block assembly and inserted into the lower housing (as illustrated in FIGS. 3B-3D). In operation, when force acts on the bull pup trigger, the linking member moves rearward thereby moving the trigger bearing element rearward such that the rearward force acts on the trigger of the firing assembly.

FIGS. 3C and 3D is an illustration of the firing assembly of a Marlin 60™ firearm within the block assembly and bull pup stock assembly having a second side of both the upper and lower housings and block assembly removed for illustration purposes. In the present embodiments, the trigger bearing element 386 is positioned in front of the trigger 301 of the firing assembly. When rearward force is acted upon the trigger linkage assembly 321 a rearward force translates to a rearward force acting upon the trigger bearing element thereby depressing the trigger 301 of the firing assembly. As mentioned above, the trigger bearing elements may have an outer housing that is configured to be rotatably attached. As the trigger bearing element moves rearwards, the trigger moves rearward, the trigger will slightly rotate upward as illustrated by curved line DDD. As the trigger moves rearward, the housing of the trigger bearing element will also rotate to accommodate the trigger 301.

The block assembly is further configured to house a release actuator 310. The release actuator is configured to pivotally couple to the first and second housings of the block assembly by at least one guide rod 315. In the present embodiment the release actuator is configured to be positioned in release actuator opening 3075 and attached to the first and second housings of the block assembly by the guide rods 315 attached to either side of the release actuator. The release actuator has a lower end 320. The lower end of the release actuator is configured to extend through a first opening 325 on a downward facing side 111 of the block assembly when the first and second housings of the block assembly are coupled to each other (see FIG. 1A). The release actuator is configured to interact with a release assembly 3025 of a firearm such that applying force to the actuator in a first direction engages the components of the release assembly. In the embodiment illustrated in FIGS. 3A-3D, the release actuator is configured to interact with a release button 3025 that protrudes from the surface of the Marlin 60™ firing assembly.

FIG. 3C is a side view of the firing assembly and trigger linkage assembly within the block assembly and having the first side of stock assembly removed for illustration purposes. FIG. 3C illustrates the Marlin 60™ configuration. However, all configurations have a common feature of allowing the fully assembled firing assembly that is housed by the block assembly to be capable of interacting with the trigger linkage assembly such that applying rearward force on the bull pup trigger 145 provides rearward force on the trigger 301 of the firearm assembly.

The block assembly is configured to house the firing assembly of the firearm. The block assembly includes restraining surfaces in order to hold the firing assembly inside of the block housing. Referring to FIG. 3C, for the block assembly configured to house the Marlin 60™ configuration, the restraining surface 3001 is configured to abut and restrain the upper rearward end of the firing assembly. Restraining surface 3003 is configured to abut the downward facing end of the trigger guard 3004. In the present embodiments, a forward insert 405 is configured to be positioned inside the U-shaped curve feature 166 of the forward end of the lower housing to support the forward end of the firearm assembly or barrel (as illustrated in FIG. 4A). The forward insert may be, elastomeric material, rubber or any other material that is capable of supporting and providing support to the forward end of the firearm. When in the fully assembled and closed configuration, a block assembly restraining member 3095 that is attached to the downward facing surface of an inside surface of the upper housing abuts and restrains the upward facing surface of the firing assembly when the firming assembly is housed by the block assembly within the stock assembly and the stock assembly 100 is in a closed position. Block assembly restraining member can comprise an elastomeric material, rubber, etc. and is configured for securing the block assembly within the housing.

FIG. 3C illustrates the release actuator 310 in the unactuated position or rearward position and FIG. 3D illustrate the release actuator in the actuated position or forward position. The release actuator is configured to pivotally attach by the guide rods 315 to the first and second housings of the block assembly so that the release actuator can pivot about the guide rods. The release actuator configured to interact with a release assembly of a Marlin 60™ firearm. For the Marlin 60™ embodiment, the release actuator is configured to interact with a release button 3025 to release the lock of the firearm assembly that prevents the bolt of the firearm returning to a closed or ready position.

In the normal operation of the Marlin 60™ firearm, the Marlin 60™ firearm has components within a release assembly 3020 of the firing assembly such that a first forwardly force in the direction of line C is provided by the release assembly to push a release button 3025 in a forward position. The release assembly moves a release button 3025 of the release assembly to a forward position maintaining a bolt of the Marlin 60™ in an open configuration when a magazine tube of the Marlin 60™ is emptied. After the Marlin 60™ has been emptied and when in the open configuration, a user can load ammunition into the loading slot of the Marlin 60™. When a user desires to close or release the bolt of the Marlin 60™, a user will push the release button inward (in the direction of line E) in order for the components of the firing assembly to release the bolt to move the firearm into the ready for fire state.

Referring back to the operation of the release actuator 310 of the block assembly, when the release button 3025 is in a forward position, the release button interacts with the upper end 3030 of the pivotally attached release actuator to move forward into a forward position (as illustrated in FIG. 3C) and a lower end 320 of the release actuator rearward.

When the bull pup assembly is fully assembled, in order to release the bolt or move the bolt into the closed configuration, a user applies a second forward force (in the direction of line D) to the bottom end 320 of the release actuator greater than the first forwardly force provided by the release assembly 3020 so that the upper end of the release actuator rotates backward (in the direction of line E) pushing the release button rearward and allowing the bolt to move to return to a closed position or ready position.

Figure 4B:
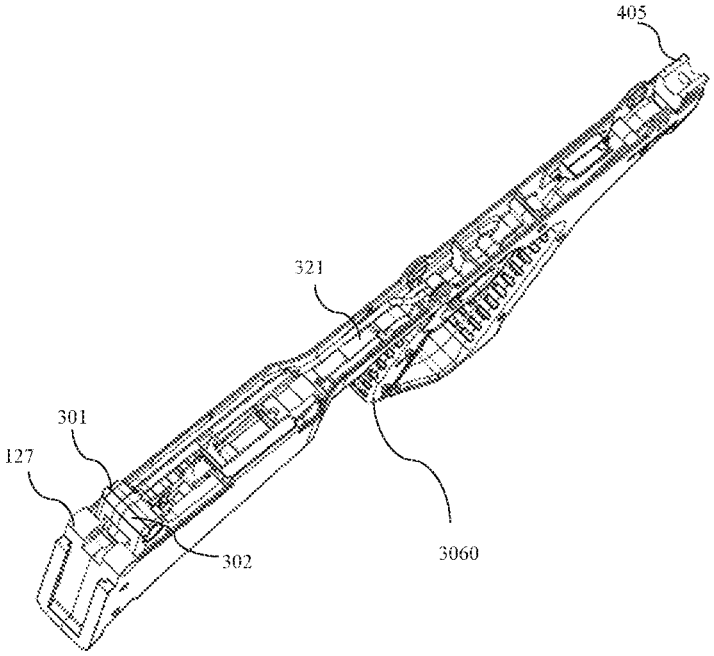
FIG. 4B is a top perspective view of the stock assembly housing the block assembly with the upper housing removed illustrating the block assembly received by the lower housing, according to an example embodiment.

Referring to FIG. 3B and FIG. 4A, as mentioned above, the first 101 and second 102 sides of the lower hosing comprises a pistol or handgrip 3060. The hand grip is configured for housing the bullpup trigger such that the forward surface 351 of the bull pup trigger protrudes out of the lower housing. FIG. 4A illustrates the interior shape of the upper and lower housing and how the shape supports the barrel and firing assembly of a firearm assembly. FIG. 4A illustrates the firing assembly of a Ruger 1022™ received by the block assembly and positioned inside of the upper and lower housings. The lower housing includes a plurality of vertically aligned support members 4005 configured to support the barrel within the lower housing. A bearing insert 405 is configured to be received by the lower housing and configured for providing support to the forward end of the barrel. The bearing insert may be sized to accommodate different sizes of barrel assemblies within the forward end of the barrel assembly. FIG. 4B illustrates the lower housing and bottom portion of the block assembly and having the barrel of the firearm assembly removed to illustrate the positioning of the block assembly within the lower housing. FIG. 4B also illustrates the bearing insert at the forward end of the weapon. The bearing element is a u shaped body that is adapted to fit into the forward end of the lower housing and is configured for supporting the forward end of a barrel of the firearm.

Referring back to FIG. 4A, coupled to the rearward side 3070 of, or behind, the bull pup trigger is the top end of a leaf spring 3055. The leaf spring the leaf spring is configured to be positioned in front of supporting element 3065 positioned inside the housing of the pistol grip. In one embodiment, the supporting element may be a series of cylindrical bodies that span from the first end to the second end of the pistol grip of the lower housing. When positioned inside the pistol grip as illustrated in FIG. 4A, the leaf spring provides a forward force to the bullpup trigger. The forward force assists with moving the trigger forward after the trigger has been depressed or moved rearward in order to fire the weapon.

Figure 5A:
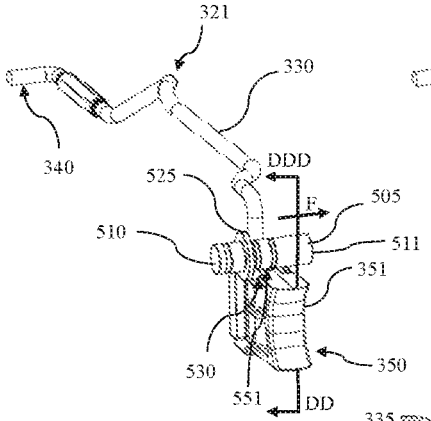
FIG. 5A is a front perspective view of the linking member coupled with the bull pup trigger and having a trigger lock in an unlocked configuration, according to an example embodiment.
Figure 5B:
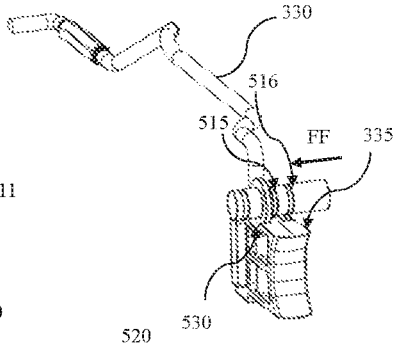
FIG. 5B is a front perspective view of the linking member coupled with the bull pup trigger and having a trigger lock in a locked configuration, according to an example embodiment.
Figure 5C:
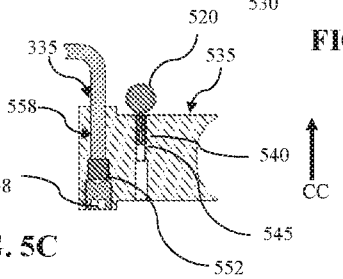
FIG. 5C is a partial cross-sectional side view of a stopping member of the trigger lock, according to an example embodiment.
Figure 5E:
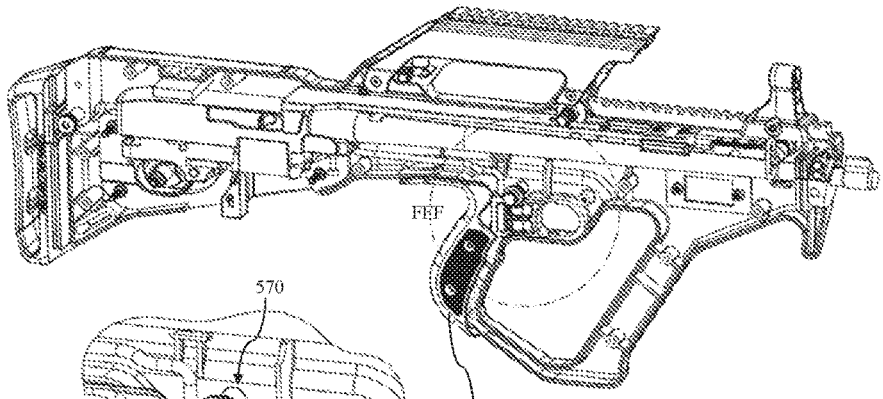
FIG. 5E is an enlarged partial perspective view of the components within circle FFF of FIG. 5D illustrating trigger lock, according to an example embodiment.
Figure 5D:
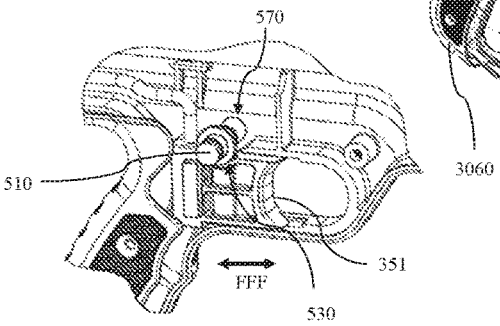
FIG. 5D is a perspective view of the stock assembly and block assembly with a side of the upper housing, lower housing and block assembly removed illustrating trigger lock, according to an example embodiment.

Referring to FIG. 5A-5D, the lower housing also includes a trigger safety lock 570 for preventing forward and rearward translation (in the direction of line FFF) of the bull pup trigger when the trigger safety lock is in a locked configuration and for allowing forward and rearward translation of the bull pup trigger when the trigger safety lock is in an unlocked configuration. The trigger safety lock includes a cylindrical shaped body 505 greater having a length greater than the width (dimension from the first side wall 1002 to the second side wall 1004, see FIG. 6F) of the pistol grip 3060 so that ends 510 of the cylindrical shaped body protrude from each side of the pistol grip (as illustrated in FIGS. 1A and 5D). The cylindrical shaped body has a pair of channels 515, 516 each configured to receive a stopping element 520. In the present embodiment, the channels 515, 516 are somewhat curved shaped channels. A first protruding element 525 radially extends beyond the cylindrical shaped body. A groove 530 is presented on an upward facing surface 535 of the bullpup trigger. The groove is configured for catching the first protruding element when the first protruding element is moved into the groove. A stopping element 520 inhibits lateral movement of the cylindrical shaped body when the received by each of the channels 515 of the cylindrical shaped body 505.

FIG. 5A is a view of the trigger lock in the unlocked position. In the unlocked position, the first protruding element 525 is positioned outside of the groove of the upward facing surface of the trigger. With the first protruding element positioned outside of the trigger, the trigger can translate laterally in the directions illustrated by lines F and FF.

FIG. 5B is a view of the trigger lock in the locked position. In the locked position, the first protruding element 525 is positioned inside the groove of the upward facing surface of the trigger. With the first protruding element positioned inside of the trigger, the trigger cannot translate forward and rearward in the directions illustrated by line FNF in FIG. 5D.

FIG. 5C is a partial cross-sectional view of a stopping element taken along line DD. In one embodiment a stopping element 520 extends upward from an upward facing surface 535 of the bullpup trigger. In the present embodiment, the stopping element is configured to be biased upward by the expanding force of a compressing spring 540 positioned on top of a shelf 545 within a trigger channel. The rearward end of the bull pup trigger may also include a channel 558 that is configured for receiving the forward end 335 of the linking member. Proximate to the tip of the linking member may include a magnet 552 that can be attracted to a conductive material 559 position within the bull pup trigger. This configuration allows the linking member to be coupled to the bull pup trigger without the use of tools.

In operation, in order to move from the unlocked position to the locked position, a user will apply force (in the direction of line F) to an end 510 of the cylindrical shaped body to move the first protruding element into the groove of the bull pup trigger. As the trigger moves laterally, the upward biasing force of the spring in the direction of line CC moves the stopping element into the outward channel thereby stopping the trigger from further movement. It is also understood that an inward wall 551 of the curved groove. To unlock the trigger lock, force (in the direction of line F) is applied to the opposite end 511 of the cylindrical shaped body sufficient to overcome the upward biasing force of the spring so that the first protruding element can be moved out of the outward channel. As the first protruding element moves outside the groove, the upward force (in the direction of line CC) of the spring 540 pushes the stopping element into the inward channel thereby increasing the amount of force required for lateral movement of the first cylindrical shaped body. When outside groove, the pull pup trigger is permitted to translate forward and rearward in the directions of line FFF so that when a rearward force is applied to the bullpup trigger the trigger of the firearm assembly is depressed via the trigger linkage assembly Referring to FIGS. 3B and 6F, the firearm assembly of a Marlin 60™ is illustrated having a bolt lock attached to the bull pup stock assembly. By way of background, for operation of certain firearms, a bolt handle is configured to allow a user to move the bolt of the firing assembly rearwards and into an open configuration. If the bolt is moved rearward and into the open configuration a user can view inside of the chamber. This allows a user to view if a round of ammunition is inside the chamber. When the bolt moves forwards, the firing assembly moves into a closed position and also loads a round into the chamber.

In FIG. 3B, the bolt lock 605 of the bull pup assembly is positioned in the unlocked configuration. The bolt lock configured to stop the bolt handle 635 of the firearm assembly and maintain the bolt of the firing assembly in an open configuration when the bolt lock is in a locked configuration. This locking function prevents the firearm assembly from allowing a round of ammunition to be loaded into the chamber. The bolt lock of the present invention is configured to allow the bolt of the firing assembly to move into a closed configuration when the firing sled is in an unlocked configuration. When in the unlocked position a sled body 610 (further explained below) of the bolt lock can be moved forwards and rearwards so that a tab 630 interacts with bolt handle of firing assembly, which can be helpful for clearing stuck rounds of ammunition, for visual inspection of the chamber, and for removing undischarged rounds of ammunition for the chamber and magazine.

Figure 6A:
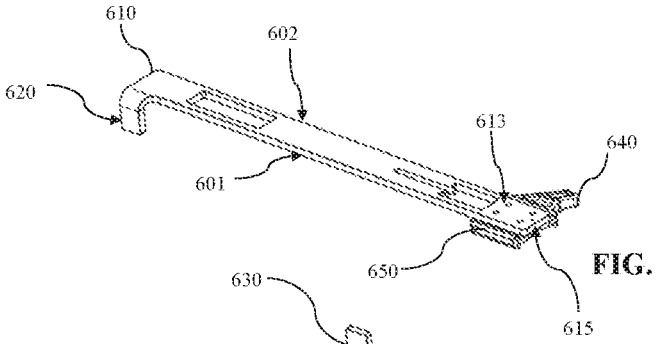
FIG. 6A is a top perspective view of the sled body, according to an example embodiment.
Figure 6B:
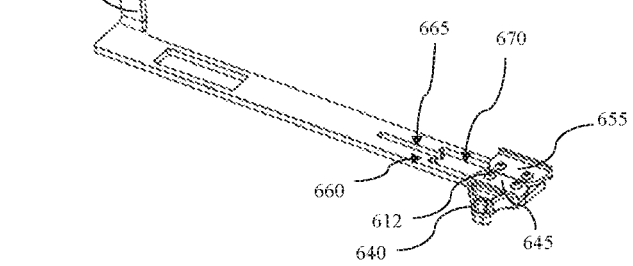
FIG. 6B is a bottom perspective view of the sled body, according to an example embodiment.

Referring to FIGS. 6A and 6B, in one embodiment, a sled body 610 having a forward end 615 opposing a rearward end 620. The sled body is an elongated planar shaped body the sled body that is configured for forward and rearward movement along a constrained path within the upper housing. A tab 630 protrudes downward from the rearward end of the sled body. The tab is positioned and configured so that the tab can engage a bolt handle of the firearm when the bolt lock is in the (as illustrated in FIG. 3B) when moved rearwards towards the bolt handle 635.

The sled body also includes a sled handle 640 attached to a first ear 645 that is configured to be coupled to either a first end 601 or a second end 602 of the forward end 615 of the sled body by at least one fastener 612. The sled handle is configured to allow a user to apply rearward force to the sled handle in order to move the sled body in the rearward direction. When fully assembled, as illustrated in FIG. 1, the first ear is configured to pass through either a first sled slot 651 or a second sled slot 652 of the upper housing such that the sled assembly can translate forward and rearward within the upper housing when the handle is coupled to the sled body through the second sled slot or first sled slot.

The bolt lock also includes a cap 650 attached to a second ear 655. The second ear is configured to be coupled to either the first or second side of the forward end of the sled body by at least one fastener 612. Similar to the first ear, the second ear is configured to pass through either the first sled slot 651 or second sled slot 652 of the stock assembly such that the sled body can translate forward and rearward within the stock assembly when the cap is coupled to the body. The sled body is configured to be positioned on top of a pair of elongated rails 699 within the upper housing (illustrated in FIG. 6F). Each rail is configured to the inside surface of the side wall of the upper housing. Each rail is configured so that the sled body can translate for the backwards along the rail.

The sled body also includes a spade shaped cutout 696 proximate to the forward end of the sled body. The spade shaped cutouts includes a spade section 670 opposing a shaft section 665. The spade shaped cutout is configured so that it can receive a second protruding element 680 of the lock button 667 (further explained below). In the present embodiments, the handle and the cap may be coupled to either the first side or second side of the forward end of the sled body. Such interchangeable positions are such that a user can change between a left-hand user position and a right-hand user position based upon user's preference.

The bolt lock also includes a sled biasing member 690, such as a compression spring. that is configured to be coupled to the upper housing in front of that sled body so that the sled body is biased forward within the upper housing. In the present embodiment, a compression spring is coupled to a spring attaching feature 669 proximate to the forward end of the upper housing.

Figure 6C:
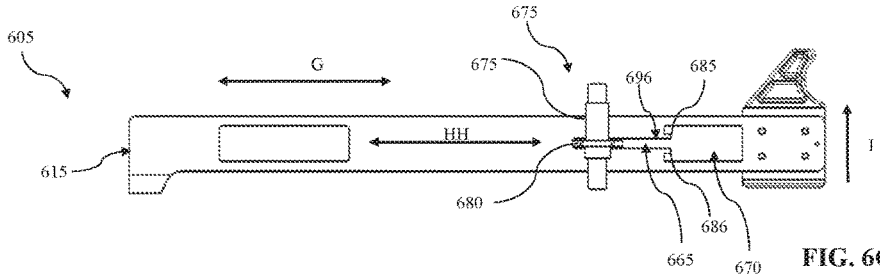
FIG. 6C is a top view illustrating components of the bolt lock, wherein the bolt lock is in an unlocked configuration, according to an example embodiment.
Figure 6D:
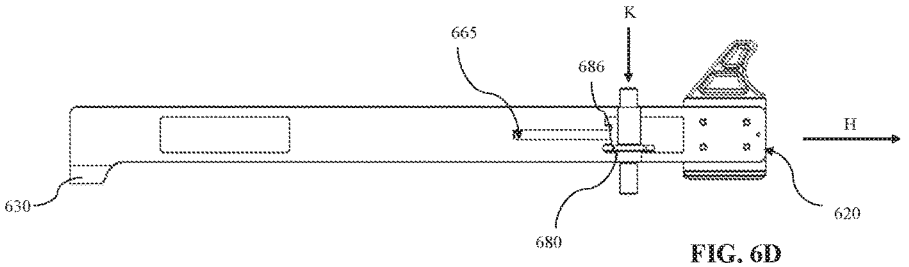
FIG. 6D is a top view illustrating components of the bolt lock, wherein the bolt lock is in a locked configuration, according to an example embodiment.
Figure 6E:
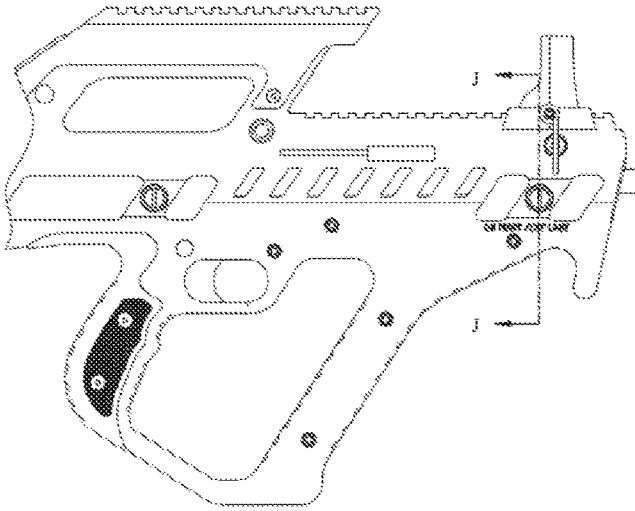
FIG. 6E is a side view of the forward end of the bull pup stock assembly housing a firearm assembly, according to an example embodiment.
Figure 6F:
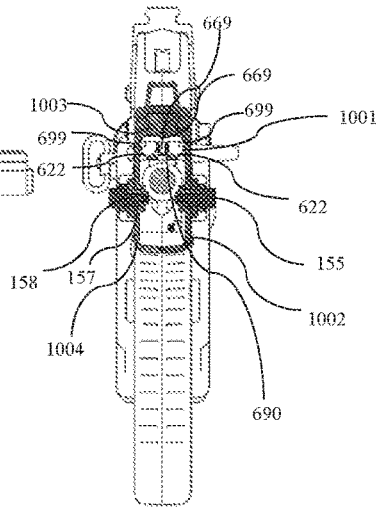
FIG. 6F is a front cross-sectional view of the forward end of the bull pup stock assembly housing a firearm assembly taken along line J of FIG. 6E, according to an example embodiment.

Referring to FIGS. 6C, 6D and 3B, the bolt lock also includes a lock button 667. The lock button comprises a second cylindrical shaped body 675 having a length greater than a width of the stock assembly. The lock button has a second protruding element 680 extending radially outward from the second cylindrical shaped body. The lock button is configured to span from the first side to the second side of the upper housing such that one end of the lock button protrudes beyond one of the sides walls of the upper housing so that the second cylindrical body of the bolt lock can be accessed from the outside of the bull pup assembly as illustrated in FIG. 1.

A button biasing member 688 (illustrated in FIG. 3B) is positioned on one side of the second protruding element encircling the second cylindrical shaped body. The button biasing member can be a compression spring that is configured to be a provide a basing force (in the direction illustrated by line I in FIG. 6D) (such that the lock button is biased toward a longitudinal midline (represented by line HH in FIG. 6C) of the spade shaped cutout so the second protruding element does not interact with a shoulder 685, 686 of the spade section when the unlocked position in the fully assembled position.

FIGS. 3B and 6C illustrates the bull pup lock in the unlocked position. In the unlocked position, the button biasing member 688 forces the second protruding element proximate to the centerline of the spade shaped cutout represented by line HH. With the second protruding element of the lock button proximate to the centerline, when force is applied in a rearward direction, the sled body can translate rearward along the centerline represented by line HH. In the open configuration, because the position of the second protruding element 680 is proximate to the centerline HH, the sled body can move forward and backwards thereby interacting with the bolt handle 635 of the firing assembly. In operation, in the open position, a user can apply rearward force to the handle 640 so that the sled body moves rearward allowing the tab 630 interact with the bolt handle.

FIG. 6D illustrates the bolt lock in the locked position. In the locked position, the lock button is positioned in the spade section of the spade shaped cutout such that the shoulder 686, 685 of the spade section prevents the biasing force of the button biasing member 688 from moving the second protruding elements into the longitudinal midline of the spade shaped cutout. In this position, the sled body is prevented from being biased forward (in the direction H) by the sled biasing member 690. In the locked configuration, the tab 630 interacts or abuts with the bolt handle 635 thereby preventing the bolt handle from moving into the closed or ready position.

In order to move from the locked position to the unlock position, a user must apply enough rearward force to the handle 640 in order to move the sled body rearwards in order for the second protruding member 680 to clear the shoulder 686. After the second protruding member clears the shoulder, the biasing force of the button biasing member will move the second protruding element into the centerline (represented by line HH) of the spade shaped cutout thereby moving the bolt lock into the unlocked position. In the unlock position, the sled body can be translated rearwards and force so that the tab can interact with the bolt handle which can be useful for clearing cartridges, as well as for viewing into the chamber.

To move from the unlocked position to the locked position, a user must apply and maintain a rearward force to the handle such that the sled body moves rearwards so that the lock button and second protruding element is positioned forward of the shoulder 685 of the spaded section 670 of the spade shaped cutout. When the lock button is in forward of or in front of the shoulders, force can be applied and the maintained in the direction of line K on the lock button so that the second protruding element moves into the spade shaped section 770 beyond the shoulder 686. After the second protruding element is beyond the shoulder 686, a user can release the rearward force on the handle 640 such that the forward force (represented by line H) of the spring biasing member moves the sled body forward in the position represented in line 6D. When in the position represented in FIG. 6D, the force on the lock button in the direction of line K can be removed while still maintaining the bolt lock in the locked configuration as the shoulder 686 will prevent the sled body from moving into the unlocked position.

Referring to FIGS. 7A-FIG. 7D, FIG. 7A is a perspective view of the assembly, having portions of the bull pup assembly housings removed so that the sight adjustment 705 can be viewed. A pair of site adjustment guide bars 710 are configured to be received within circular channels 780 on a base section 711 of the site adjustment. A first adjustment screw 740 is configured to the threaded into a threaded cylindrical channel 750 situated between the circular channels 780. At each end of the first adjustment screw is a knob 731, 735 that is configured for allowing a user to apply rotational forces to the first adjustment screw so that the base can be translated laterally when the site adjustment is installed between the first and second sidewalls of the upper housing. A first base biasing member 720 or compression spring is installed between the knob 731 and base section 711 of the sight adjustment. The base biasing member 720 provides a biasing force against the base of the sight adjustment. The biasing force provided by provides tension to the sight adjustment to facilitate maintaining the sight adjustment in a single lateral position and prevents backlash of the horizontally aligned first adjustment screw.

The sight adjustment also includes a fixed vertically aligned second crew 745 that protrudes from the upward facing end of the base. The second adjustment screw 745 is fixed, not capable of rotating within a tubular shaped body 775 that protrudes upward from the base. A vertically aligned second base spring 730 is positioned surrounding the second adjustment screw. A tubular shaped insert 760 having a central circular channel 765 is configured to be received by the second adjustment screw and inside of the tubular shaped body 775. A vertically aligned rail 763 is on each side of the body of the tubular shaped insert. The upward end of the spacer includes an upside down V-shaped protrusion 761. The upside down V-shaped protrusion is configured to correspond with a matching upside down V-shaped indentations 765, 767 on a lower end of a tubular shaped crosshair body 766 (further explained below). The vertically aligned rails are configured to align with a pair of detents 770, 771 along the inside surface of the tubular shaped body 775. In operation, when the spacer is inserted into the tubular shaped body 775, the ribs match with the detents thereby preventing the spacer from rotational movement.

A tubular shaped crosshair body 766 has a threaded channel along the bottom end of the body (not shown). The lower end of the tubular shaped crosshair body also includes two upside down v-shaped indentations 765, 767, wherein each upside down V-shaped indentation is perpendicularly aligned. Each of the upside down V-shaped indentations is configured to match with the upside down V-shaped protrusion 761 of the spacer. The threaded channel of the tubular shaped crosshair body is configured to be screwed onto the second adjustment screw 745.

Figure 7B:
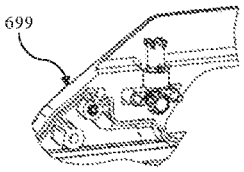
FIG. 7B is an enlarged perspective view illustrating the components within circle B of FIG. 7A, illustrating the sight adjustment, according to an example embodiment.
Figure 7A:
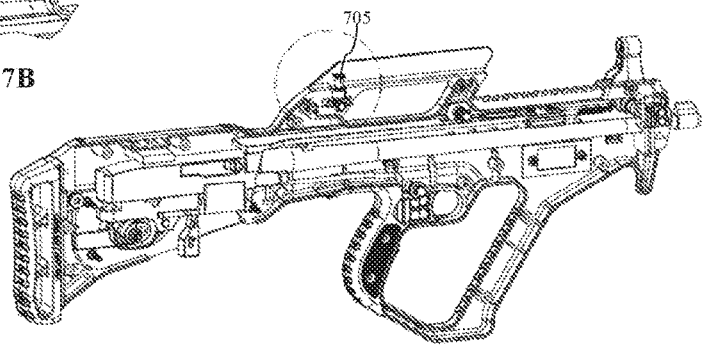
FIG. 7A is a perspective view of the stock assembly and block assembly with a side of the upper housing, lower housing and block assembly removed illustrating the sight adjustment, according to an example embodiment.
Figure 7D:
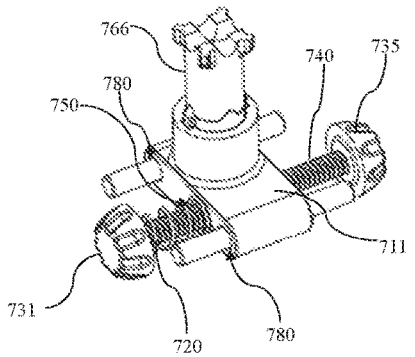
FIG. 7D is an exploded perspective view of the sight adjustment, according to an example embodiment.
Figure 7C:
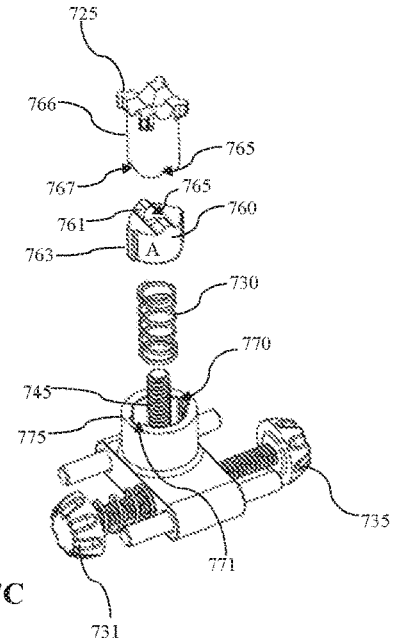
FIG. 7C is a perspective view of the sight adjustment, according to an example embodiment.

In operation, when the device is fully assembled as illustrated in FIG. 7D, the vertically aligned second base spring 730 provides an upward force that pushes the tubular shaped insert upwards and into the lower end of the crosshair tubular shaped body 776. The crosshair body can be rotated so that the crosshairs 725 on the upper end of the crosshair body can be moved upwards and downwards. As the crosshair body is rotated, the upside down V-shaped protrusion of the spacer 760 aligns with one of the opposing upside down the shaped indentation 766, 767 every 90°. The matching upside down V-shaped protrusions and indentations provides a catching or stopping feature such that the crosshairs can only be rotated 90° for proper alignment of the crosshairs. In operation, when the site adjustment is positioned within between the first and second sides of the upper housing, as illustrated in FIGS. 7A and 7B, the first adjustment screw can be rotated so that the site adjustment can be laterally move between the first and second housings.

The material used to make the stock and other components may a molded plastic construction but may be made of wood or other suitable materials, such as aluminum, machined aluminum etc.

Referring to FIGS. 1-4A, 5A-5C and in order to assemble the device without the use of tools a user may position the Marlin 60™ firing assembly between the first and second housings of the block assembly. Next, the user will position the trigger bearing element 386 in front of the trigger 301 of the firing assembly. Next a user can insert the second end 340 of the linking member into the shuttle opening 390 thereby coupling the linking member with the trigger bearing element. Next, a user can position the guide rod 315 into the opening (not shown) proximate to the actuator opening 3075 configured for receiving the guide rod. Next, a user can couple the actuating member 820 onto the guide rod. Next, a user will next position the firing assembly so that the surfaces of the firing assembly are mated with the restraining surfaces of the block assembly, the bearing element 395 fits into the bearing slot (not shown) of the first housing, align the threaded openings 3012 align with the threaded openings 3011, position the linking member inside of the slot and then a can use the spade screws 396 to couple the first and second side of the block assembly together as illustrated in (FIG. 2A) without the use of tools. Next, the firing assembly and block assembly can be positioned inside of the lower housing and the forward end 335 of the linking member 330 can be connected with the opening at rearward end of the bull pup trigger. As mentioned above, the forward end of the linking member may comprise a magnet such that it attracts a conductive material 559 within the rearward end of the bull pup trigger so that the linking member can be coupled to the bull pup trigger without tools. Next, the user can couple the sides of the upper and lower housings using the quarter turn fasteners as explained above. Finally, a user can then use the rearward end locking means to further couple the upper and lower housings together so that the Marlin 60 firearm assembly is positioned inside the block assembly in a locked configuration. To remove the firing assembly, the operation described above is completed in a reverse.

Referring to FIGS. 4AA and 8A-8C, a Ruger 1022™ is housed within the block assembly and received by the upper and lower housings of the bull pup stock (see FIG. 4AA). The firing assembly is received within the block assembly. The restraining surface 8001 restrains a rearward end of the firearm assembly inside the housing. Restraining surface 8003 also restrains the rearward end and provides a surface that abuts the trigger guard 8004 of the firing assembly. In all embodiments of the bull pup stock assembly, a forward insert 405 (illustrated in FIG. 4A) is configured to be positioned inside the U-shaped curve feature 166 of the forward end of the lower housing to support the forward end of the firearm assembly or barrel. The forward insert may be, elastomeric material, rubber or any other material that is capable of supporting and providing support to the forward end of the firearm. When in the fully assembled and closed configuration, a block assembly restraining member 815, which is coupled to the downward facing surface of the upper housing, abuts and restrains the upward facing surface of the firing assembly, which is for restraining the firing assembly within the block assembly as explained above.

For a Ruger 1022™ firearm assembly, the bull pup stock 100 is used and the block assembly is configured so that it can support the firing assembly of the Ruger 1022™. Similar to the embodiment for the Marlin 60™, the embodiment for the Ruger 1022™ firearm assembly also comprises a release actuator configured to couple to the first 801 and second housings 802 of the block assembly by at least one guide rod 815. For the Ruger 1022™ embodiment, the release actuator is configured to translate upwards and downwards. In operation, a lever 8025 of the firing assembly of the Ruger 1022™ is normally in a first position as illustrated in 8A and extending from the surface of the firing assembly when a cartridge (not shown) is installed within the firing assembly. In operation, a user will apply force in an upward direction to the lever 8025 of the firearm assembly in order to release a magazine (not shown) attached to the firing assembly.

Referring back to the bull pup stock assembly, the release actuator 820 is configured to interact with a release lever 8025 of a release assembly of a firearm such that applying an upward force to the release actuator in an upward direction engages the lever 805 of the release assembly casing the release assembly to release the magazine of the firearm assembly. The release actuator 810 has a lower end 820. The lower end of the release actuator is configured to extend through a first opening 805 on a downward facing side of the block assembly when the first and second housings of the block assembly are coupled to each other. In operation, in order to release the meaning of the firing assembly, a user will apply force in the direction of line L in order to release the magazine assembly. FIG. 3B illustrates the release actuator moved upward and having a force in the direction of line L acting, which would cause a magazine (not shown) to be released.

Figure 8A:
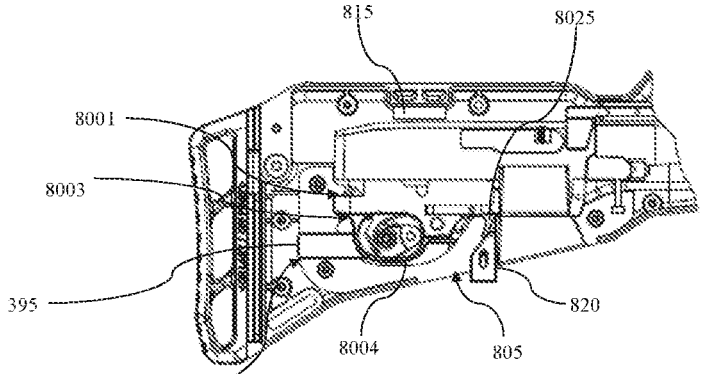
FIG. 8A is a side partial view of the stock assembly and block assembly with a side of the upper and lower housings and block assembly removed illustrating a release button of another firing assembly in a forward position, according to an example embodiment.
Figure 8B:
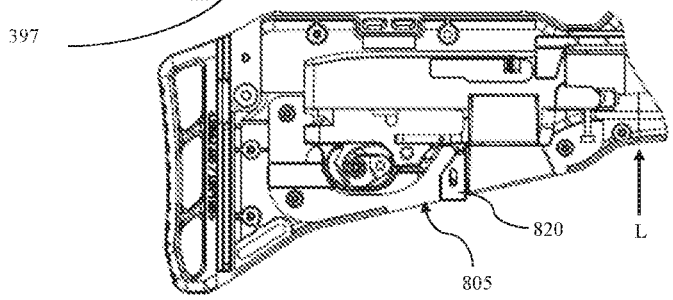
FIG. 8B is a side partial view of the stock assembly and block assembly with a side of the upper and lower housings and block assembly removed illustrating another firing assembly within the block assembly, according to an example embodiment.
Figure 8C:
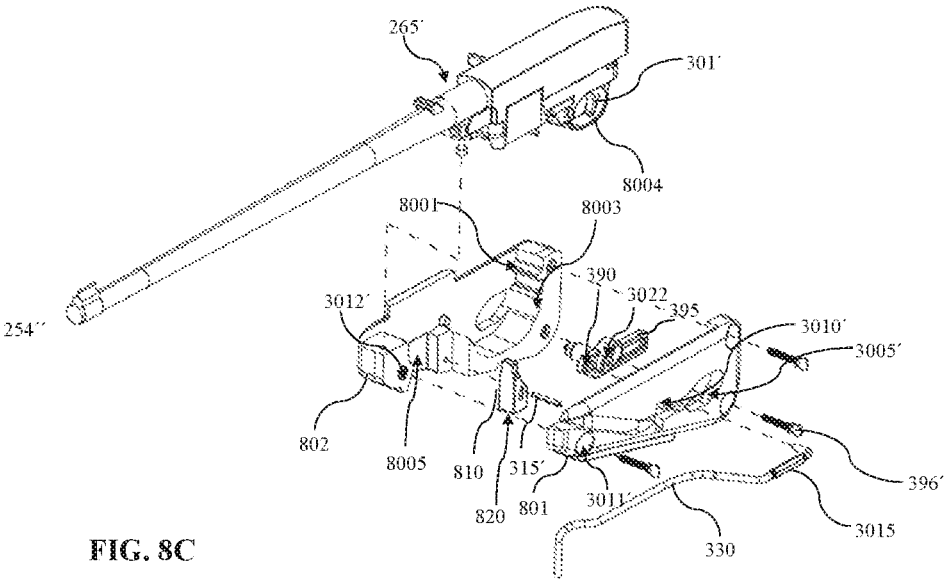
FIG. 8C is a partially exploded view of another firearm assembly and a block assembly of the bull stock assembly, according to an example embodiment; and, FIG. 8D is a partially exploded view of another firearm assembly and a block assembly of the bull stock assembly, according to an example embodiment.

FIG. 8C is a partially exploded view of the Ruger 1022 firearm assembly and a block assembly of the bull stock assembly. FIG. 8C further illustrates how the block assembly is configured to receive a firearm assembly. Similar with the block assembly for other embodiments, the block assembly for the Ruger 1022 is also configured to the be assembled without use of tools and only using human muscle power to assemble the firing assembly inside the block assembly.

Similar to the block assembly for the Marlin 60™, block assembly for the Ruger 1022, the first housing 801 has a plurality of bosses 3011' configured to align with the threaded holes 3012' of the second housing so that a spade screw 396' and can be screwed into and used couple the first and second housings together. The outside surface of the block assembly proximate to the threaded holes 3012' of the second housing has a cutout 3013' and is configured so that the spade screw can be fastened securely to the first and second housings while providing space for a user to use the digits of a hand to turn or screw the spade screws into the bosses. The cutout 3013' allows a user to tighten the spade screws sufficiently so that the first and second housings of the block assembly are securely joined.

Similar to the block assembly for the Marlin 60™, the Ruger 1022 configuration includes a slot 3005' configured for allowing a linking member 330 (explained above) to translate forward and rearward when the linking member is received by the block assembly. Also, as explained above, an access aperture 3010' is also included on at least one of the housings of the block assembly and is configured to provide access to a trigger play adjuster 3015' of the trigger linkage assembly (further explained above). The access aperture is a rectangular shaped opening perpendicular aligned with the body of the slot 3005'.

FIG. 8C also illustrates trigger bearing element 386. In FIG. 8A-8C, the trigger bearing element is coupled inside the forward opening 3022 and is arranged for a Ruger 1022 firing assembly. The trigger bearing element is configured to interact with the trigger 301' of the firearm when the firearm is received by the block assembly and inserted into the lower housing (as further explained above). In operation, when force acts on the bull pup trigger, the linking member moves rearward thereby moving the bearing element rearward such that the rearward force acts on the trigger firing the weapon.

In operation, in order to assemble the device without the use of tools a user may position the Ruger 1022™ firing assembly between the first and second housings of the block assembly. Next, the user will position the trigger bearing element 386 in front of the trigger 301' of the firing assembly. Next a user can insert the second end of the linking member into the shuttle opening 390 thereby coupling the linking member with the trigger bearing element. Next, a user can position the guide rod 315' into the opening 119' configured for receiving the guide rod. Next, a user can couple the actuating member 820 onto the guide rod. Next, a user will next position the bearing element 395 into the bearing slot (not shown) of the first housing, align the threaded openings 3012' align with the threaded openings 3011', position the linking member inside of the slot and then a can use the spade screws 396' to couple the first and second side of the block assembly together as similar to illustrated as in (FIG. 2A) without the use of tools. Next, the firing assembly and block assembly can be positioned inside of the lower housing and the forward end 335 of the linking member can be connected with the rearward end of the bull pup trigger. The forward end of the linking member may comprise a magnet such that it attracts a conductive material 559 within the rearward end of the bull pup trigger so that the linking member can be coupled to the bull pup trigger without tools. Next, the user can couple the sides of the upper and lower housings using the quarter turn fasteners as explained above. Finally, a user can then use the rearward end locking means to further couple the upper and lower housings together.

Figure 8D:
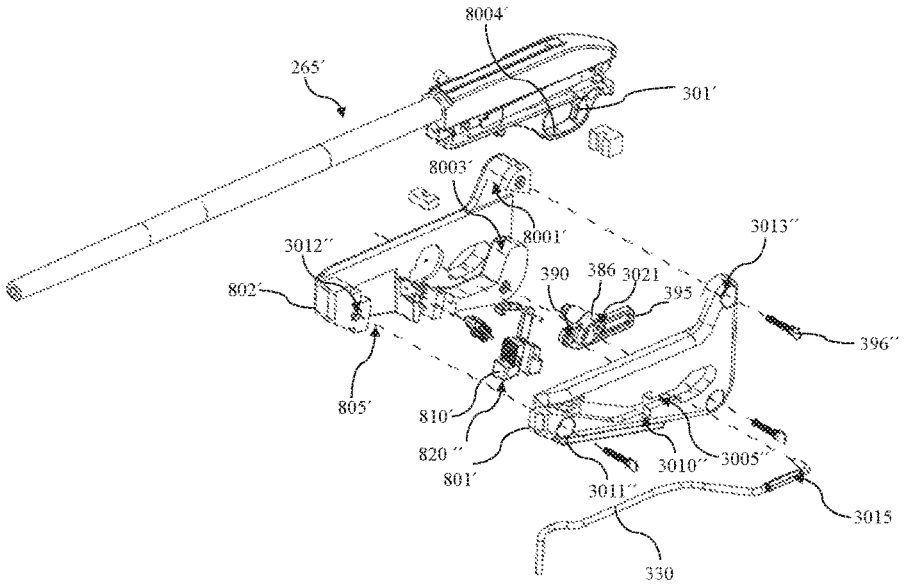

FIG. 8D is a partially exploded view of a Marlin 795™ firearm assembly and a block assembly of the bull stock assembly. Similar with the block assembly for other embodiments, the block assembly for the Ruger Marlin 795™ is also configured to the be assembled without use of tools and only using human muscle power to assemble the firing assembly inside the block assembly.

Similar to the block assembly for other embodiments, block assembly for the Marlin 795™ includes a first housing 801' that has a plurality of bosses 3011" configured to align with the threaded holes 3012" of the second housing so that a spade screw 396" and can be screwed into and used couple the first and second housings together. The outside surface of the block assembly proximate to the threaded holes 3012" of the second housing has a cutout 3013" and is configured so that the spade screw can be fastened securely to the first and second housings while providing space for a user to use the digits of a hand to turn or screw the spade screws into the bosses. The cutout 3013" allows a user to tighten the spade screws sufficiently so that the first and second housings of the block assembly are securely joined.

Similar to the block assembly for other firing assemblies, the block assembly for the Marlin 795™ configuration includes a slot 3005" configured for allowing a linking member 330 (explained above) to translate forward and rearward when the linking member is received by the block assembly. Also, as explained above, an access aperture 3010' is also included on at least one of the housings of the block assembly and is configured to provide access to a trigger play adjuster 3015 of the trigger linkage assembly (further explained above). The access aperture is a rectangular shaped opening perpendicular aligned with the body of the slot 3005'.

FIG. 8D also illustrates trigger bearing element 386. In FIG. 8A, the trigger bearing element is coupled inside the rearward opening 3021' and is arranged for a Marlin 795™ configuration. The trigger bearing element is configured to interact with the trigger 301" of the firearm when the firearm is received by the block assembly and inserted into the lower housing (as further explained above). In operation, when force acts on the bull pup trigger, the linking member moves rearward thereby moving the trigger bearing element rearward such that the rearward force acts on the trigger to fire the weapon.

FIG. 8D also illustrates that restraining surface 8001' restrains a rearward end of the firearm assembly inside the housing. Restraining surface 8003' restrains the rearward end and provides a surface that abuts the trigger guard 8004' of the firing assembly. In the present embodiments, a forward insert 405 (illustrated in FIG. 4A) is configured to be positioned inside the U-shaped curve feature 166 of the forward end of the lower housing to support the forward end of the firearm assembly or barrel. The forward insert may be, elastomeric material, rubber or any other material that is capable of supporting and providing support to the forward end of the firearm. When in the fully assembled and closed configuration, a block assembly restraining member is attached to the downward facing surface of the upper housing abuts and restrains the upward facing surface of the firing assembly.

Similar to other embodiments, the embodiment for the Marlin 795™ firing assembly also comprises a release actuator configured to couple to the first 801' and second housings 802' of the block assembly. The release actuator 810' has a lower end 820'. The lower end of the release actuator is configured to extend through a first opening 805' on a downward facing side of the block assembly when the first and second housings of the block assembly are coupled to each other. The release actuator 810' is configured to interact with a release assembly of a firearm such that applying force to the release actuator in a first direction engages the components of the release assembly.

Similar to the other embodiments, in operation, in order to assemble the device without the use of tools a user may position the Marlin 795™ firing assembly between the first and second housings of the block assembly. Next, the user will position the trigger bearing element 386 in front of the trigger 301' of the firing assembly. Next, a user will next position the bearing element 395 into the bearing slot (not shown) of the first housing, align the threaded openings 3012" align with the threaded openings 3011', position the linking member inside of the slot 3005" and then a can use the spade screws 396" to couple the first and second side of the block assembly together as similar to illustrated as in (FIG. 2A) without the use of tools. Next, the firing assembly and block assembly can be positioned inside of the lower housing and the forward end 335 of the linking member can be connected with the rearward end of the bull pup trigger. The forward end of the linking member may comprise a magnet such that it attracts a conductive material 559 within the rearward end of the bull pup trigger so that the linking member can be coupled to the bull pup trigger without tools. Next, the user can couple the sides of the upper and lower housings using the quarter turn fasteners as explained above. Finally, a user can then use the rearward end locking means to further couple the upper and lower housings together.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A bullpup stock assembly configured for housing a firearm assembly without the use of tools, the bullpup stock assembly comprising:

an upper housing having a rearward end opposing a forward end, wherein the rearward end of the upper housing is configured to hingedly couple with a lower housing;

the lower housing having a rearward end opposing a forward end, wherein the rearward end of the lower housing is configured to hingedly couple with the upper housing;

a hinging means configured for hingedly coupling the upper and lower housings, wherein the stock assembly is in a closed configuration when the forward ends upper and lower housing are joined, wherein the stock assembly is in an open configuration the upper and lower housing are not joined;

a bullpup trigger configured to communicate with a trigger of the firearm assembly by a trigger linkage assembly such that the bullpup trigger activates the firearm when squeezed;

a trigger linkage assembly configured to allow a bullpup trigger to communicate with the trigger of the firearm;

a block assembly configured to house a firing assembly of the firearm assembly and the trigger linkage assembly, wherein the block assembly is configured to be received and constrained by the upper and lower housing when the stock assembly is in a closed configuration;

at least one locking means for locking the upper and lower housings together when the forward ends of the upper and lower housing are joined.

2. The stock assembly of claim 1, wherein the locking means comprises a rearward end locking means comprising:

a u-shaped wall on the rearward end of the lower housing, the u-shaped wall including a protruding catching feature;

a pair of opposing vertically aligned walls on the rearward end of the upper housing, the vertically aligned walls each including a second protruding catching feature;

wherein a gap is defined between the u-shaped wall and vertically aligned walls when the stock assembly is in the closed configuration;

a butt cover having a first protruding flanged feature and a second protruding flanged feature, wherein the protruding flanged features are separated by a second gap, wherein the protruding flanged features are configured to mate with the protruding catching features of the lower and upper housings when the stock assembly is in the closed configuration; and, a lock bar, the lock bar configured to fit into a space formed by the first and second gaps when the stock assembly is in the closed configuration and the butt cover is coupled to the stock assembly.

3. The stock assembly of claim 1, wherein the locking means comprises at least one quarter-turn fastener on a first side of the stock assembly, and at least quarter-turn one fastener on a second side of the housing, the quarter-turn fasteners are configured for coupling the sides of upper and lower housing together when the stock assembly is in the closed configuration.

4. The stock assembly of claim 1, wherein the trigger linkage assembly comprises:

a linking member, the linking member comprising a first end opposing a second end, the first end of the linking member is configured to couple to the bullpup trigger, and the second end is configured to couple to a trigger shuttle;

an trigger shuttle configured for forward and rearward translation within the block housing, the trigger shuttle comprising a forward end opposing a rearward end, the forward end configured to couple with the linking member, the rearward end comprising a bearing element configured to translate rearward and forward within a bearing slot of the block assembly; and, a trigger bearing element, the trigger bearing element is rotatably coupled to and protruding from a side of the trigger shuttle, the trigger bearing element is configured to interact with the trigger of the firearm when the firearm is received by the block assembly and inserted into the lower housing.

5. The stock assembly of claim 4, wherein the lower housing further comprises:

a pistol grip for housing the bullpup trigger;

a leaf spring coupled behind the bullpup trigger, wherein the leaf spring is configured to engage with a supporting element inside the pistol grip, the leaf spring providing a forward force to the bullpup trigger;

a trigger safety lock for preventing forward and rearward translation of the bull pup trigger when the trigger safety lock is in a locked configuration and for allowing forward and rearward translation of the bull pup trigger when the trigger safety lock is in an unlocked configuration.

6. The stock assembly of claim 5, wherein the trigger safety lock comprises:

a cylindrical shaped body greater having a length greater than a width of the pistol grip so that ends of the cylindrical shaped body protrude from each side of the pistol grip, and having a pair of channels each configured to receive a stopping element;

a first protruding element radially extending beyond the cylindrical shaped body;

a groove presented on an upward facing surface of the bullpup trigger, the groove configured for catching the first protruding element when the protruding element is moved into the groove; and, a stopping element extending upward from an upward facing surface of the bullpup trigger, the stopping element configured to be biased upward, and wherein the stopping element inhibits lateral movement of the cylindrical shaped body when the received by each of the channels.

7. The stock assembly of claim 4, wherein the linking member includes a forward linking section coupled with a rearward linking section by a linking coupler, wherein a forward end of the linking coupler is configured for coupling with the forward linking section by a first thread arrangement, and a rearward end of the linking coupler is configured for coupling with the rearward section linking section by a second thread arrangement such that rotating the threaded coupling adjusts a length of the linking member.

8. The stock assembly of claim 4, wherein the block assembly comprises:

a first housing opposing a second housing, wherein the first and second housings are configured to couple to each other;

a plurality of surfaces on at least one of the housings of the block assembly configured for housing and restraining portions of a firearm;

a slot on one of the housings configured for allowing the linking member to translate forward and rearward when the linking member is received by the block assembly; and;

an access aperture on at least one of the housings of the block assembly configured to provide access to a trigger play adjuster of the trigger linkage assembly.

9. The stock assembly of claim 8, wherein the block assembly comprises a release actuator configured to couple to the first and second housings of the block assembly by at least one guide rod, the release actuator having a lower end, wherein the lower end of the release actuator is configured to extend through a first opening on a downward facing side of the block assembly when the first and second housings of the block assembly are coupled to each other, and wherein the release actuator is configured to interact with a release assembly of a firearm such that applying force to the release actuator in a first direction engages the components of the release assembly.

10. The stock assembly of claim 9, wherein the release actuator is configured to pivotally attach by the guide rods to the first and second housings of the block assembly, the release actuator configured to interact with a release assembly of a Marlin 60 firearm;

wherein the Marlin 60 firearm is configured such that a first forwardly force provided by the release assembly moves a release button of the release assembly to a forward position and positioning a bolt of the Marlin 60 in an open configuration when a magazine tube of the Marlin 60 is emptied;

wherein when the release button is in a forward position, the release button pushes an upper end of the actuator forward and a lower end of the release actuator rearward;

and wherein the release actuator is configured such that when a second forward force is applied, greater than the first forwardly force of the release assembly, to the lower end of the release actuator, the upper end of the release actuator rotates backward pushing the release button rearward and allowing the bolt of the Marlin 60 to move to return to a closed position.

11. The stock assembly of claim 10, wherein the stock assembly comprises a bolt lock, the bolt lock configured to stop the bolt handle of the firearm assembly and maintain the bolt of the firing assembly in an open configuration when the bolt lock is in a locked configuration, and the bolt lock configured to allow the bolt of the firing assembly to move into a closed configuration when the firing sled is in an unlocked configuration.

12. The stock assembly of claim 11, wherein the bolt lock comprises:

a sled body having a forward end opposing a rearward end, the sled body configured for forward and rearward movement along a constrained path within the upper housing;

a sled biasing member, the sled return biasing member configured for biasing the sled body forward within the upper housing;

a tab proximate to the rearward end of the sled body, wherein the tab is configured to engage a bolt handle of the firearm when the bolt lock is in the locked configuration;

a sled handle attached to a first ear, wherein the first ear is configured to be coupled to either a first or second side of the forward end of the sled body by at least one fastener, wherein the first ear is configured to pass through either a first or second sled slot of the upper housing such that the sled assembly can translate forward and rearward within the upper housing when the sled handle is coupled to the sled body;

a cap attached to a second ear, the second ear configured to be coupled to either the first or second side of the forward end of the sled body by at least one fastener, wherein the second ear is configured to pass through either the first or second sled slot of the stock assembly such that the sled body can translate forward and rearward within the stock assembly when the cap is coupled to the body;

a spade shaped cutout on the sled body;

a lock button, the lock button comprises a second cylindrical shaped body having a length greater than a width of the stock assembly, the lock button having a second protruding element extending radially outward from the second cylindrical shaped body, the lock button configured to span from the first side to the second side of the upper housing such that at least one end of the lock button protrudes beyond one of the sides of the upper housing;

wherein the lock button is arranged such that when the sled assembly is in the unlocked configuration the second protruding element can translate within a shaft section and a spade section of the spade shape cutout along a constrained path, and such that when the sled is in the locked configuration the second protruding element is positioned in the spade section of the spade shaped cutout and is prevented from moving into the shaft section by a shoulder of the spade section; and, a button biasing member, the button biasing member configured to provide a basing force such that the lock button is biased toward a longitudinal midline of the shade shaped cutout so the second protruding element does not interact with the shoulder of the spade section.

13. The stock assembly of claim 1, wherein the upper housing further comprises at least one sight adjustment, the sight adjustment configured for vertical and lateral adjustment of a sight cross hair.

14. A bullpup stock assembly configured for housing a firearm assembly without the use of tools, the bullpup stock assembly comprising:

an upper housing having a rearward end opposing a forward end, wherein the rearward end of the upper housing is configured to hingedly couple with a lower housing;

the lower housing having a rearward end opposing a forward end, wherein the rearward end of the lower housing is configured to hingedly couple with the upper housing;

a hinging means configured for hingedly coupling the upper and lower housings, wherein the stock assembly is in a closed configuration when the forward ends upper and lower housing are joined, wherein the stock assembly is in an open configuration the upper and lower housing are not joined;

a bullpup trigger configured to communicate with a trigger of the firearm assembly by a trigger linkage such that the bullpup trigger activates the firearm when a rearward force acts on the bull pup trigger;

a trigger linkage assembly configured to allow a bullpup trigger to communicate with a trigger of the firearm;

a block assembly configured to house a firing assembly of the firearm assembly and the trigger linkage assembly, wherein the block assembly is configured to be received and constrained by the upper and lower housing when the stock assembly is in a closed configuration, the block assembly comprising:

a first housing opposing a second housing, wherein the first and second housings are configured to couple to each other by spade fasteners, the spade fasteners configured to manipulated without the use of tools;

a plurality of surfaces on at least one of the housings of the block assembly configured for supporting and restraining portions of a firearm;

a slot on one of the housings configured for allowing a linking member of the trigger linkage assembly to translate forward and rearward when the linking member is received by the block assembly;

an access aperture perpendicularly aligned with slot, the access aperture configured to provide access to a trigger play adjuster of the trigger linkage assembly;

a rearward end locking means, the rearward end locking means comprising:

a u-shaped wall along the rearward end of the lower housing, each u-shaped wall including a protruding catching feature;

a pair of vertically aligned walls on the rearward end of the upper housing, the vertically aligned walls each including a second protruding catching feature;

wherein a gap is formed between the u-shaped wall and vertically aligned walls when the stock assembly is in a closed configuration;

a butt cover having a first protruding flanged feature and a second protruding flanged feature, wherein the protruding flanged features are separated by a second gap, the protruding flanged features are configured to mate with the protruding catching features of the lower and upper housings when the stock assembly is closed providing a first rearward locking feature; and, a lock bar, the lock bar configured to fit into a space formed by the first and second gaps when the stock assembly is closed and the butt cover is coupled to the stock assembly, the lock bar providing a second rearward end locking feature;

at least one quarter-turn fastener on a first side of the stock assembly, and at least quarter-turn one fastener on a second side of the housing, the quarter-turn fasteners are configured for coupling the sides of upper and lower housing together when the stock assembly is in the closed configuration;

a bolt lock, the bolt lock configured to stop the bolt handle of the firearm and maintain the bolt of the firing assembly in an open configuration when the bolt lock is in a locked configuration, and the bolt lock configured to allow the bolt of the firing assembly to move into a closed configuration when the firing sled is in an unlocked configuration; and, wherein the stock assembly is configured to receive a plurality of firearm assemblies that have been received by the block assembly.

15. The stock assembly of claim 14, wherein the trigger linkage assembly comprises:

a linking member, the linking member comprising a first end opposing a second end, the first end of the linking member is configured to couple to the bullpup trigger, and the second end is configured to couple to a trigger shuttle;

an trigger shuttle configured for forward and rearward translation within the block housing, the trigger shuttle comprising a forward end opposing a rearward end, the forward end configured to couple with the linking member, the rearward end comprising a bearing element configured to translate rearward and forward within a bearing slot of the block assembly; and, a trigger bearing element, the trigger bearing element is rotatably coupled to and protruding from a side of the trigger shuttle, the trigger bearing element is configured to interact with the trigger of the firearm when the firearm is received by the block assembly and inserted into the lower housing.

16. The stock assembly of claim 14, wherein the bolt lock comprises:

a sled body having a forward end opposing a rearward end, the sled body configured for forward and rearward movement along a constrained path within the upper housing;

a sled biasing member, the sled return biasing member configured for biasing the sled body forward within the upper housing;

a tab proximate to the rearward end of the sled body, wherein the tab is configured to engage a bolt handle of the firearm when the bolt lock is in the locked configuration and unlocked configuration;

a sled handle attached to a first ear, wherein the first ear is configured to be coupled to either a first or second side of the forward end of the sled body by at least one fastener, wherein the first ear is configured to pass through either a first or second sled slot of the upper housing such that the sled assembly can translate forward and rearward within the upper housing when the sled handle is coupled to the sled body;

a cap attached to a second ear, the second ear configured to be coupled to either the first or second side of the forward end of the sled body by at least one fastener, wherein the second ear is configured to pass through either the first or second sled slot of the stock assembly such that the sled body can translate forward and rearward within the stock assembly when the cap is coupled to the body;

a spade shaped cutout on the sled body;

a lock button, the lock button comprises a second cylindrical shaped body having a length greater than a width of the stock assembly, the lock button having a second protruding element extending radially outward from the second cylindrical shaped body, the lock button configured to span from the first side to the second side of the upper housing such that at least one end of the lock button protrudes beyond one of the sides of the upper housing;

wherein the lock button is arranged such that when the sled assembly is in the unlocked configuration the second protruding element can translate within a shaft section and a spade section of the spade shape cutout along a constrained path, and such that when the sled is in the locked configuration the second protruding element is positioned in the spade section of the spade shaped cutout and is prevented from moving into the shaft section by a shoulder of the spade section; and, a button biasing member, the button biasing member configured to provide a basing force such that the button is biased toward a longitudinal midline of the shade shaped cutout so the second protruding element does not interact with the shoulder of the spade section.

17. The stock assembly of claim 14, wherein a block assembly restraining member is coupled to a downward facing surface inside the upper housing, the block restraining member configured to abut an upward facing surface of block assembly when the block assembly is in the stock assembly and the upper and lower housings are in the closed configuration, a forward insert configured to be positioned at the forward end of the lower housing to support a barrel of the firearm assembly when upper and lower housings are in the closed configuration.

18. The stock assembly of claim 14, wherein a release actuator is configured to pivotally attach by at least one guide rod to the first and second housings of the block assembly, the release actuator configured to interact with a release assembly of a Marlin 60 firearm;

wherein the Marlin 60 firearm is configured such that a first forwardly force provided by the release assembly moves a release button of the release assembly to a forward position when a magazine tube of the Marlin 60 is emptied thereby maintaining a bolt of the Marlin 60 in an open configuration;

wherein when the release button is the forward position, the release button pushes an upper end of the release actuator forward and a lower end of the release actuator rearward;

and wherein the release actuator is configured such that when a second forward force is applied, greater than the first forwardly biasing force of the release assembly, to the lower end of the release actuator, the upper end of the release actuator rotates backward pushing the release button rearward and allowing the bolt to move to return to a closed position.

* * * * *